US010584006B2

(12) United States Patent
Suzuki et al.

(10) Patent No.: US 10,584,006 B2
(45) Date of Patent: Mar. 10, 2020

(54) SHEET CONVEYING APPARATUS AND IMAGE FORMING APPARATUS PROVIDED WITH THE SHEET CONVEYING APPARATUS

(71) Applicant: CANON KABUSHIKI KAISHA, Tokyo (JP)

(72) Inventors: Yohei Suzuki, Mishima (JP); Shunsuke Okazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/825,933

(22) Filed: Nov. 29, 2017

(65) Prior Publication Data

US 2018/0148285 A1 May 31, 2018

(30) Foreign Application Priority Data

Nov. 30, 2016 (JP) ..... 2016-233353

(51) Int. Cl.
*B65H 3/06* (2006.01)
*B65H 5/06* (2006.01)

(52) U.S. Cl.
CPC ..... *B65H 5/062* (2013.01); *B65H 3/06* (2013.01); *B65H 3/0638* (2013.01); (Continued)

(58) Field of Classification Search
CPC .... B65H 3/0684; B65H 3/062; B65H 3/5261; B65H 3/0669; B65H 2601/61; B65H 5/062; B65H 3/06
See application file for complete search history.

(56) References Cited

U.S. PATENT DOCUMENTS 6,059,280 A * 5/2000 Yamauchi ..... B65H 3/5261 193/35 R
8,079,586 B2 12/2011 Watanabe
(Continued)

FOREIGN PATENT DOCUMENTS

CN 102556710 A 7/2012
CN 105102360 A 11/2015
(Continued)

OTHER PUBLICATIONS

Machine translation of JP2001-171852, 2001. (Year: 2001).*

*Primary Examiner* — Thomas A Morrison
(74) *Attorney, Agent, or Firm* — Canon U.S.A., Inc. IP Division

(57) ABSTRACT

A sheet conveying apparatus includes a rotation member unit, a supporting shaft and a moving shaft to support the rotation member unit, a locking unit to lock the moving shaft, and an engaged portion. The rotation member unit includes an engaging portion and a sheet conveyance rotation member held by the engaging portion. When the moving shaft is at a first position, the moving shaft and the supporting shaft support the rotation member unit. When the moving shaft is moved away from the supporting shaft to a second position at which the rotation member unit is not supported by the supporting shaft, the moving shaft is locked at the second position by the locking unit after moving from the first position to the second position, and the rotation member unit is held by the engaged portion in a state in which the engaging portion engages with the engaged portion.

20 Claims, 16 Drawing Sheets

(52) U.S. Cl.
CPC ..... *B65H 3/0669* (2013.01); *B65H 3/0684* (2013.01); *B65H 2402/5155* (2013.01); *B65H 2402/543* (2013.01); *B65H 2402/64* (2013.01); *B65H 2403/42* (2013.01); *B65H 2404/13421* (2013.01); *B65H 2601/324* (2013.01); *B65H 2601/61* (2013.01)

(56) References Cited

U.S. PATENT DOCUMENTS

| | | | | |
|---|---|---|---|---|
| 8,894,061 | B2 * | 11/2014 | Matsuoka ..... | B65H 5/06 271/10.13 |
| 9,527,685 | B2 | 12/2016 | Kawamura | |
| 9,607,091 | B2 | 3/2017 | Tischer | |
| 9,862,558 | B2 | 1/2018 | Tahara | |
| 9,880,505 | B2 | 1/2018 | Matsumoto | |
| 2015/0344245 | A1 | 12/2015 | Matsuo | |
| 2017/0131674 | A1 | 5/2017 | Tomoe | |
| 2017/0217707 | A1 | 8/2017 | Fujinuma | |

FOREIGN PATENT DOCUMENTS

| | | | |
|---|---|---|---|
| JP | 643071 | Y2 | 11/1994 |
| JP | 11-227962 | A | 8/1999 |
| JP | 11-227963 | A | 8/1999 |
| JP | 11-343038 | A | 12/1999 |
| JP | 2000327147 | A | 11/2000 |
| JP | 2001171852 | A | 6/2001 |
| JP | 2005206312 | A | 8/2005 |
| JP | 201611213 | A | 1/2016 |

* cited by examiner

SHEET CONVEYING APPARATUS AND IMAGE FORMING APPARATUS PROVIDED WITH THE SHEET CONVEYING APPARATUS

BACKGROUND OF THE INVENTION

Field of the Invention

The present disclosure relates to a sheet conveying apparatus for conveying a sheet and an image forming apparatus provided with the sheet conveying apparatus.

Description of the Related Art

Conventionally, configurations which include sheet conveying apparatuses for conveying sheets stored in sheet feeding cassettes to image forming units and forming images on sheets conveyed by the sheet conveying apparatuses are known as electrophotographic method type image forming apparatuses and the like. Some of these sheet conveying apparatuses include feeding rollers for feeding sheets stored in the sheet feeding cassettes and conveyance rollers for conveying the sheets fed from the feeding rollers to the image forming units. The feeding rollers and the conveyance rollers convey sheets using frictional force between surfaces of the rollers and surfaces of the sheets stored in the sheet feeding cassettes, and the roller surfaces wear down little by little by friction against the sheets, so that the rollers need to be replaced periodically.

Japanese Patent Application Laid-Open No. 2016-11213 describes a configuration of a sheet conveying apparatus in which a feeding roller and a conveyance roller are unitized as a rotation member unit which can be replaced by a user and a service person (hereinbelow, referred to as a user). One end side of the rotation member unit is rotatably supported by a slide shaft urged by a spring toward the rotation member unit, and another end side is rotatably supported by a drive shaft provided on an opposite side of the slide shaft across the rotation member unit. According to Japanese Patent Application Laid-Open No. 2016-11213, the rotation member unit is replaced by following operations.

First, a user slides and moves the rotation member unit to a direction from the drive shaft to the slide shaft against an urging force of the slide shaft applied toward the rotation member unit by the spring and releases engagement between the drive shaft and the rotation member unit. Subsequently, the user moves the rotation member unit to a direction for releasing the engagement with the slide shaft in a state in which the urging force is applied from the slide shaft and detaches the rotation member unit from the sheet conveying apparatus. When the rotation member unit is attached to the sheet conveying apparatus, first, a user inserts one end side of the rotation member unit into the slide shaft in a state of being urged by the spring and expands an interval between the slide shaft and the drive shaft against the urging force of the spring while engaging the one end side of the rotation member unit with the slide shaft. Subsequently, the user places the rotation member unit between the slide shaft and the drive shaft, adjusts another end side of the rotation member unit to a position capable of engaging with the drive shaft, and moves the rotation member unit to a direction to which the urging force of the slide shaft is applied after the position of the rotation member unit is adjusted. Accordingly, the rotation member unit engages with the drive shaft and is attached to the sheet conveying apparatus.

According to the configuration described in Japanese Patent Application Laid-Open No. 2016-11213, when the rotation member unit is replaced in the sheet conveying apparatus, a user needs to detach the rotation member unit against the urging force of the slide shaft urged by the spring. The configuration according to Japanese Patent Application Laid-Open No. 2016-11213 has an attaching/detaching property.

SUMMARY OF THE INVENTION

The present disclosure is directed to an attaching/detaching property of a rotation member unit with respect to a sheet conveying apparatus without a need to resist an urging force of a slide shaft.

According to an aspect of the present invention, a sheet conveying apparatus includes a rotation member unit including a conveyance rotation member configured to convey a sheet and a holding member including an engaging portion for engaging with an engaged portion provided to the sheet conveying apparatus and configured to hold the conveyance rotation member, a supporting shaft configured to support an end side of the rotation member unit in an axial direction of the conveyance rotation member, a moving shaft configured to support another end side of the rotation member unit in the axial direction and be able to move to a first position for supporting the rotation member unit together with the supporting shaft and a second position further apart from the supporting shaft than the first position in the axial direction, and a locking unit configured to lock the moving shaft at the second position with respect to the sheet conveying apparatus, wherein, by the rotation member unit being moved to a position at which the rotation member unit is not supported by the supporting shaft in the axial direction, the moving shaft is locked at the second position by the locking unit after moving from the first position to the second position, and the rotation member unit is held by the engaged portion in a state in which the engaging portion engages with the engaged portion.

Further features of the present invention will become apparent from the following description of embodiments with reference to the attached drawings.

DESCRIPTION OF THE EMBODIMENTS

Various embodiments will be described in detail below with reference to the attached drawings. According to the following embodiments, a laser beam printer is described as an example of an image forming apparatus provided with a sheet feeding apparatus. However, components described in the embodiments are merely examples and not meant to limit the scope unless otherwise specifically stated.

Figure 1:
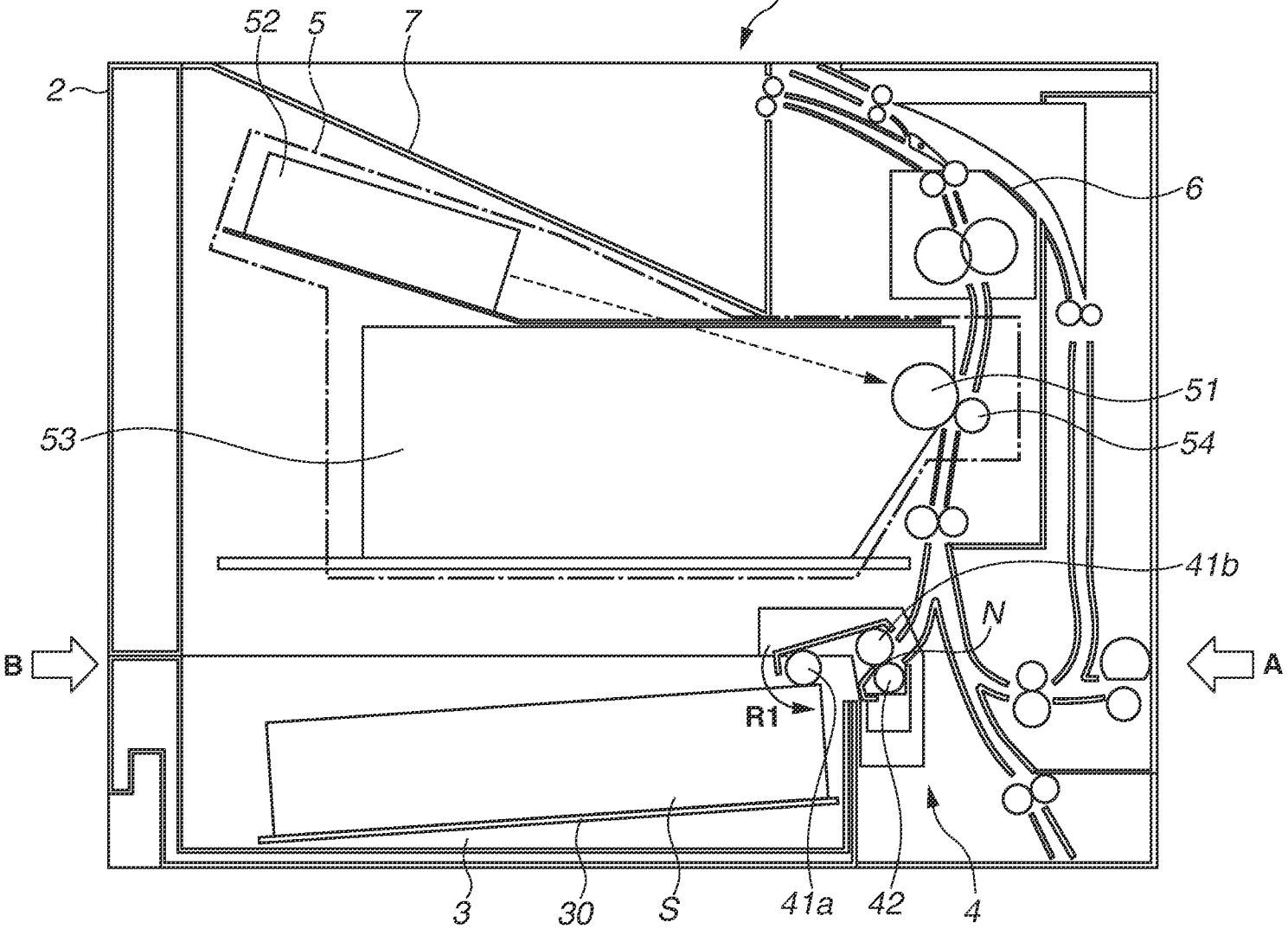
FIG. 1 is a schematic cross-sectional view illustrating a configuration of an image forming apparatus provided with a sheet conveying apparatus according to a first embodiment.

FIG. 1 is a schematic cross-sectional view illustrating a configuration of an image forming apparatus 1 provided with a sheet conveying apparatus according to a first embodiment. As illustrated in FIG. 1, the image forming apparatus 1 forms an image by an electrophotographic printing method and includes an apparatus main body 2 (hereinbelow, referred to as the main body 2), a sheet feeding cassette 3 as a sheet storage unit, a feeding unit 4, an image forming unit 5, a fixing unit 6, and a sheet discharge tray 7.

The sheet feeding cassette 3 includes a stacking plate 30 for stacking a sheet S, and the stacking plate 30 can be lifted to a position at which an uppermost surface of the sheet S abuts on a feeding roller 41*a* as a feeding rotation member for feeding the sheet S. When the uppermost surface of the sheet S abuts on the feeding roller 41*a*, the sheet S is fed by the feeding roller 41*a* rotating in a direction shown by an arrow R1 to a separation nip portion N formed by a conveyance roller 41*b* as a conveyance rotation member and a separation roller 42. The sheet S is separated by the separation nip portion N one sheet each and then conveyed to the image forming unit 5.

The image forming unit 5 includes a photosensitive drum 51 as an image bearing member, an exposure unit 52, a development unit 53, and a transfer roller 54. When a control unit (not illustrated) such as a controller receives an image signal, an image forming operation is started, and the photosensitive drum 51 is driven to rotate. The photosensitive drum 51 is uniformly charged by a charge unit, not illustrated, in a rotation process and exposed with light by the exposure unit 52 in response to the image signal. Accordingly, an electrostatic latent image is formed on a surface of the photosensitive drum 51 and then developed by the development unit 53, so that a toner image is formed on the surface of the photosensitive drum 51. The transfer roller 54 forms a transfer nip portion by abutting on the photosensitive drum 51. The toner image formed on the surface of the photosensitive drum 51 is transferred onto the sheet S fed by the feeding unit 4 at the transfer nip portion, heated and pressed by the fixing unit 6, and fixed onto the sheet S. Thus, an image is formed on the sheet S in the image forming unit 5, and the sheet S passes through the fixing unit 6 and is discharged to the sheet discharge tray 7 after completion of printing.

[Feeding Unit]

Figure 2A:
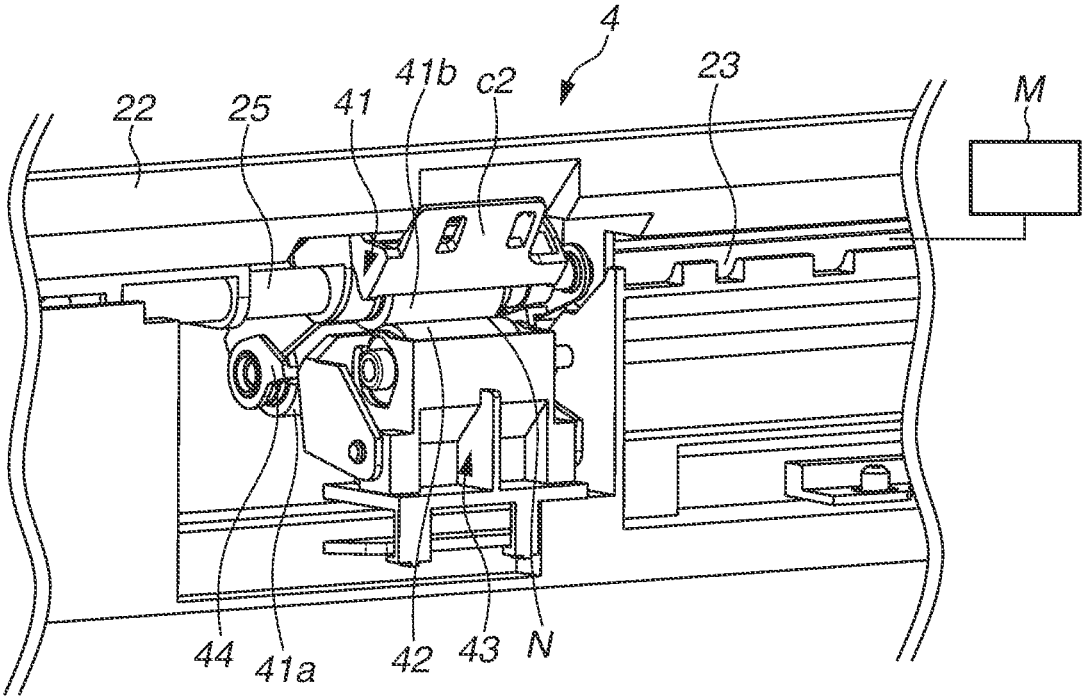
FIGS. 2A and 2B are perspective views illustrating a configuration of a feeding unit according to the first embodiment.
Figure 2B:
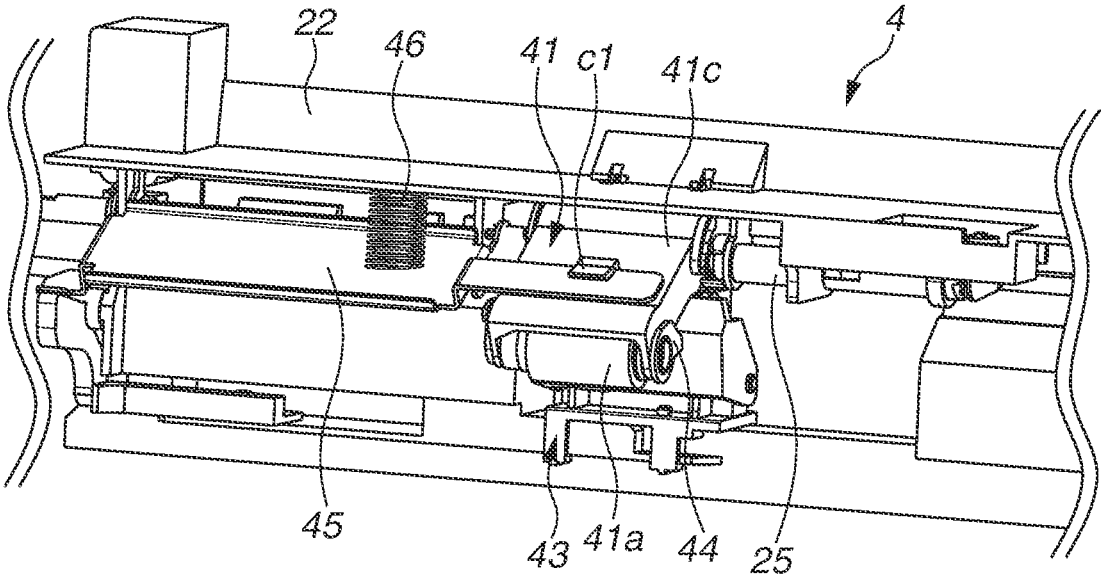

Next, a configuration of the feeding unit 4 is described in detail below with reference to FIGS. 2A and 2B. FIG. 2A is a perspective view illustrating the feeding unit 4 viewed from a direction shown by an arrow A in FIG. 1. FIG. 2B is a perspective view illustrating the feeding unit 4 viewed from a direction shown by an arrow B in FIG. 1.

As illustrated in FIG. 2A, the feeding unit 4 includes a frame 22, a coupling shaft 23 (a supporting shaft) driven by a motor M (a driving source), a rotation member unit 41, a separation unit 43, and a slide shaft 25 (a moving shaft). The feeding unit 4 further includes a detection member 44 for detecting the uppermost surface of the sheet S stacked on the stacking plate 30. The coupling shaft 23 and the slide shaft 25 are supported by the frame 22, and the slide shaft 25 is provided to be movable in an axial direction of the slide shaft 25.

As illustrated in FIG. 2B, the feeding unit 4 includes a feeding roller arm 45 for switching orientations of the rotation member unit 41 and a spring 46 (a third urging member) for urging the feeding roller arm 45. The feeding roller arm 45 is an engaged portion which is provided to the frame 22 to be movable in a vertical direction and can engage with a claw portion c1 as an engaging portion provided to a holder 41*c* of the rotation member unit 41. The spring 46 urges the feeding roller arm 45, and thus the rotation member unit 41 can be urged toward the sheet S stacked on the stacking plate 30 of the sheet feeding cassette 3. A method for switching the orientation of the rotation member unit 41 is described in detail below.

Figure 3:
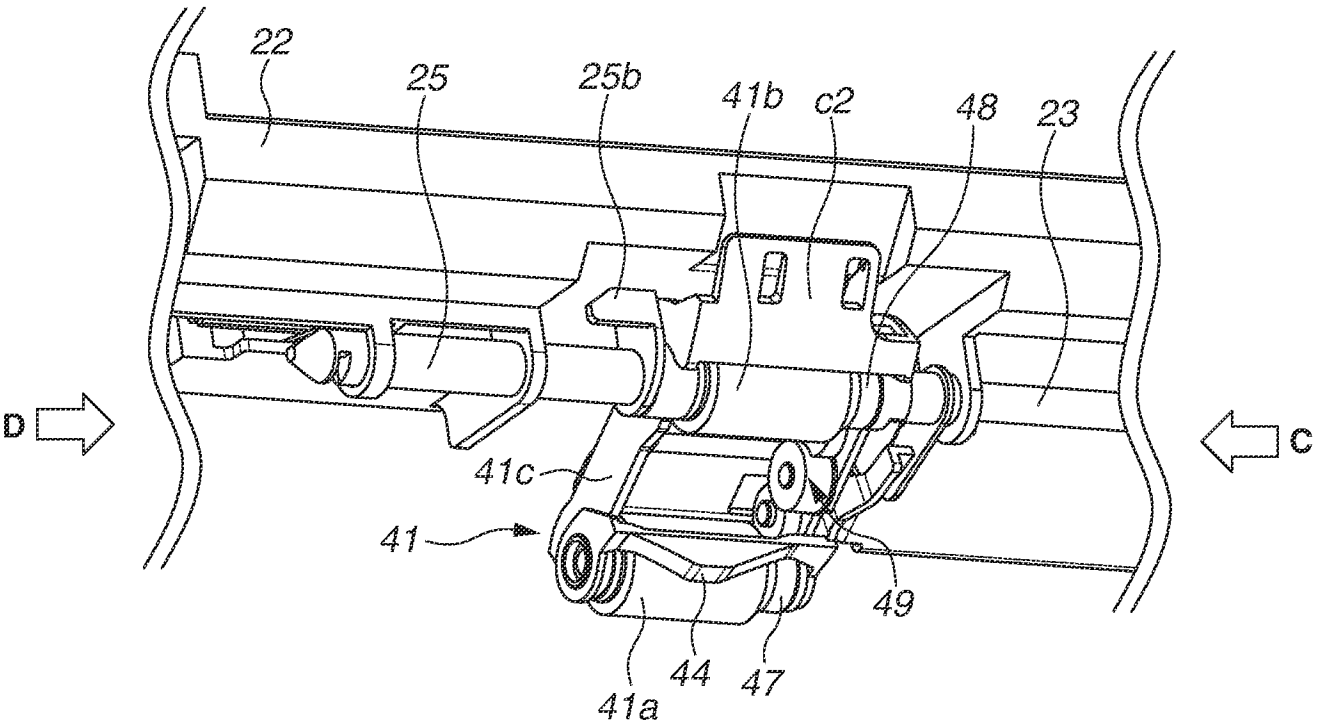
FIG. 3 is a perspective view illustrating a configuration of a rotation member unit according to the first embodiment.
Figure 4A:
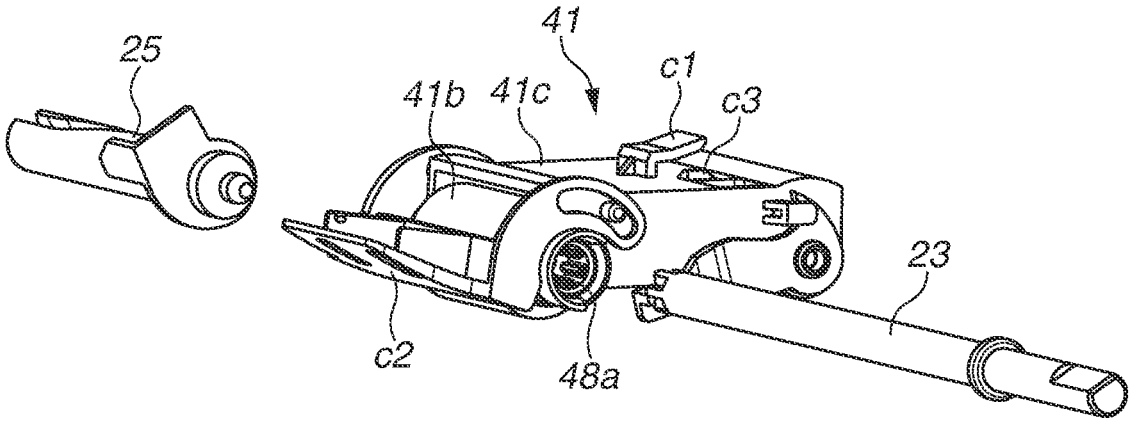
FIGS. 4A and 4B are schematic diagrams illustrating engagement among a supporting shaft, a moving shaft, and the rotation member unit according to the first embodiment.
Figure 4B:
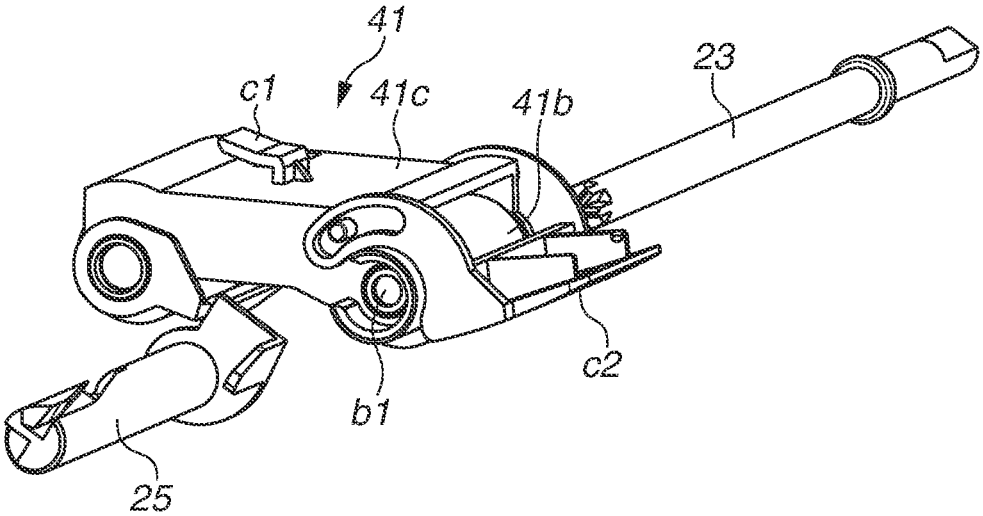

FIG. 3 is a schematic diagram illustrating a configuration of the rotation member unit 41 attached to the feeding unit 4. FIG. 4A is a schematic diagram illustrating the configuration of the rotation member unit 41 viewed from a direction shown by an arrow C in FIG. 3, and FIG. 4B is a schematic diagram illustrating the configuration of the rotation member unit 41 viewed from a direction shown by an arrow D in FIG. 3.

As illustrated in FIG. 3, the rotation member unit 41 includes the holder 41*c* as a holding member, the feeding roller 41*a* rotatably supported by the holder 41*c*, and the conveyance roller 41*b*. The feeding roller 41*a* is disposed on an upstream side than the conveyance roller 41*b* in a sheet conveyance direction and feeds the sheet S stored in the sheet feeding cassette 3 toward the conveyance roller 41*b*. One end side of the conveyance roller 41*b* is rotatably supported by the coupling shaft 23 and another end side is rotatably supported by the slide shaft 25. In the configuration according to the present embodiment, the conveyance roller 41*b* is rotatably supported by the coupling shaft 23 and the slide shaft 25, and thus the one end side of the rotation member unit 41 is supported by the coupling shaft 23 and the other end side of the rotation member unit 41 is supported by the slide shaft 25. Outer peripheral surfaces of the feeding roller 41*a* and the conveyance roller 41*b* are formed by elastic members such as rubber.

The holder 41*c* of the rotation member unit 41 includes a guide portion c2 that a user and a service person (hereinbelow, referred to as a user) can grip when attaching or detaching the rotation member unit 41 to or from the feeding unit 4, and both ends of the guide portion c2 are rotatably supported by the holder 41*c*. The guide portion c2 is held by a snap fit, not illustrated, with respect to the frame 22 in a state in which the conveyance roller 41*b* is rotatably supported by the coupling shaft 23 and the slide shaft 25 and conveys the sheet S. In a state in which the guide portion c2 is held with respect to the frame 22, the guide portion c2 is held by a wall surface of a conveyance path for guiding conveyance of the sheet S and can guide the conveyance of the sheet S.

A feeding gear 47 is disposed on a rotation axis line of the feeding roller 41*a*, and when the feeding gear 47 rotates, a driving force is transmitted to the feeding roller 41*a* via a one-way mechanism, not illustrated, and the feeding roller 41*a* is rotated. On a rotation axis line of the conveyance roller 41*b*, a conveyance gear 48 is disposed which engages with the coupling shaft 23 and transmits a driving force of the coupling shaft 23 to the feeding gear 47.

As illustrated in FIG. 4A, the coupling shaft 23 rotatably supports the conveyance roller 41*b* by engaging with an engaging groove 48*a* of the conveyance gear 48 and transmits a driving force to the conveyance roller 41*b* via a one-way mechanism, not illustrated. As illustrated in FIG. 4B, the slide shaft 25 rotatably supports the conveyance roller 41*b* by engaging with an engaging hole b1 disposed on the conveyance roller 41*b*.

According to the present embodiment, a one-way mechanism, not illustrated, is provided so that a frictional force acting between the feeding roller 41*a* and the conveyance roller 41*b* and the sheet S does not disturb the conveyance of the sheet S when the motor M as the driving source is stopped. By the one-way mechanism, not illustrated, in the case that the motor M is stopped, and the driving force is not transmitted to the feeding roller 41*a* and the conveyance roller 41*b*, the feeding roller 41*a* and the conveyance roller 41*b* can rotate by following the conveyance of the sheet S.

Figure 5:
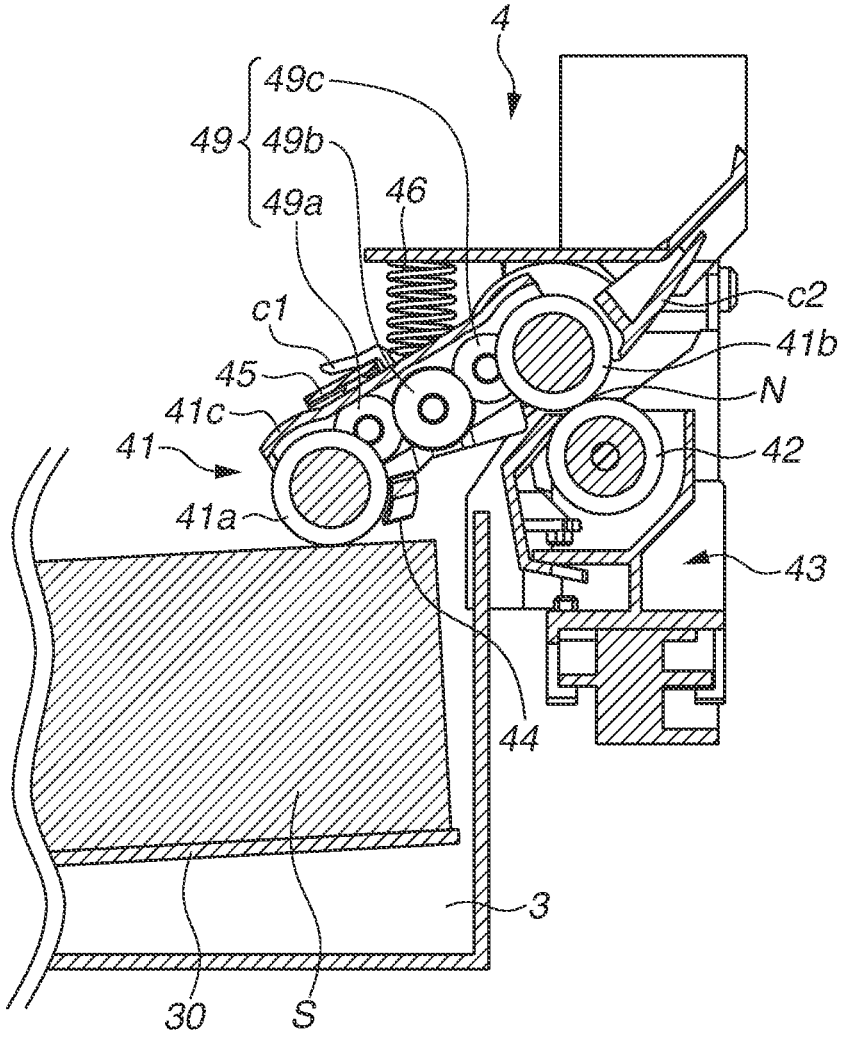
FIG. 5 is a schematic cross-sectional view of the feeding unit viewed along a sheet conveyance direction according to the first embodiment.

FIG. 5 is a schematic cross-sectional view of the feeding unit 4 viewed along the sheet conveyance direction. As illustrated in FIG. 5, a transmission gear unit 49 constituted of a plurality of gears 49*a*, 49*b*, and 49*c* is provided between the conveyance gear 48 and the feeding gear 47 and rotatably supported with respect to the holder 41*c*. In other words, when the driving force of the motor M is transmitted to the conveyance gear 48 via the coupling shaft 23, the conveyance gear 48 and the conveyance roller 41*b* are rotated, and when the driving force is transmitted to the feeding gear 47 via the transmission gear unit 49, the feeding roller 41*a* is rotated.

[Lift-Up Control of Stacking Plate]

Next, lift-up control of the stacking plate 30 is described with reference to FIG. 5. As illustrated in FIG. 5, the rotation member unit 41 is provided with the detection member 44 for detecting a stacking surface of the sheet S. The detection member 44 has a fulcrum on an extended line of the rotation axis line of the feeding roller 41*a* and is rotatably supported by the holder 41*c*. When the stacking plate 30 is lifted by a driving force from a motor, not illustrated, an uppermost sheet S stacked on the stacking plate 30 abuts on the detection member 44. When the stacking plate 30 is further lifted, and the detection member 44 is rotated for a predetermined angle, the detection member 44 is detected by a sensor, not illustrated, and the motor for driving the stacking plate 30 is stopped by a control unit, not illustrated.

In this state, the uppermost sheet S stacked on the stacking plate 30 is brought into contact with the feeding roller 41*a*, a driving force is transmitted from the motor M to the coupling shaft 23, and thus the conveyance roller 41*b* and the feeding roller 41*a* are rotated. Accordingly, the sheet S is fed by the feeding roller 41*a* to the separation nip portion N, separated one sheet each by the conveyance roller 41*b* and the separation roller 42 at the separation nip portion N, and then conveyed to the image forming unit 5. When the number of the sheets S stacked on the stacking plate 30 decreases, the rotation member unit 41 gradually moves downward by an urging force of the spring 46, and the feeding roller 41*a* and the detection member 44 are moved downward.

When a certain number of the sheets S is fed, and the detection member 44 turns and reaches a position not detected by the sensor, not illustrated, the control unit, not illustrated, lifts up the stacking plate 30 so that the detection member 44 turns to a position to be detected by the sensor, not illustrated. Thus, a height of the uppermost sheet S stacked on the stacking plate 30 is controlled to be constantly within a certain range.

[Switching of Orientation of Rotation Member Unit]

Figure 6A:
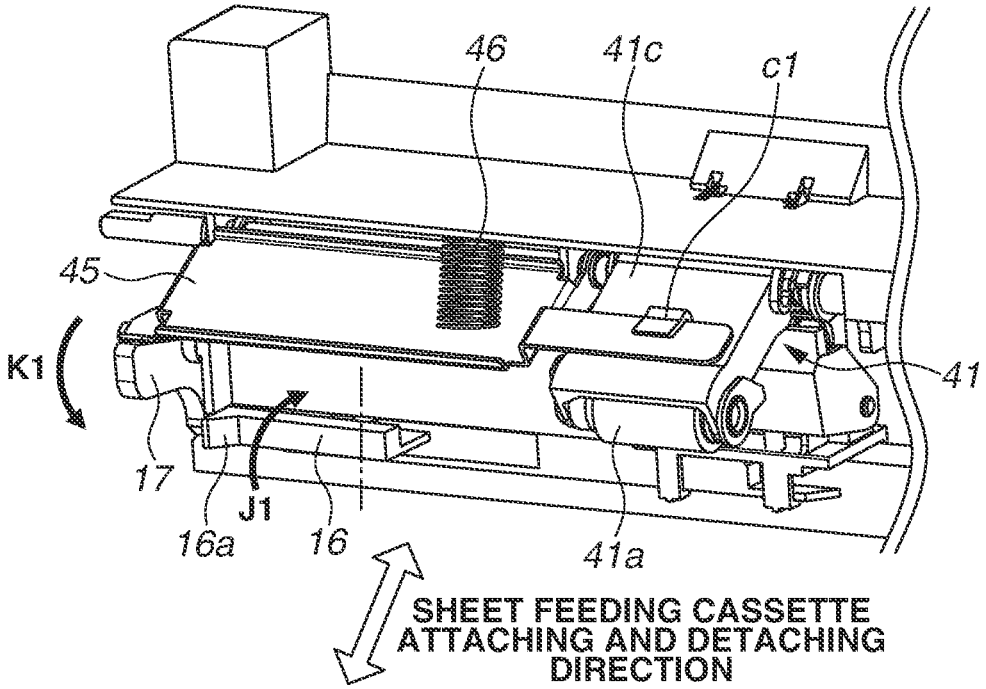
FIGS. 6A and 6B are schematic diagrams illustrating switching of orientations of the rotation member unit according to the first embodiment.
Figure 6B:
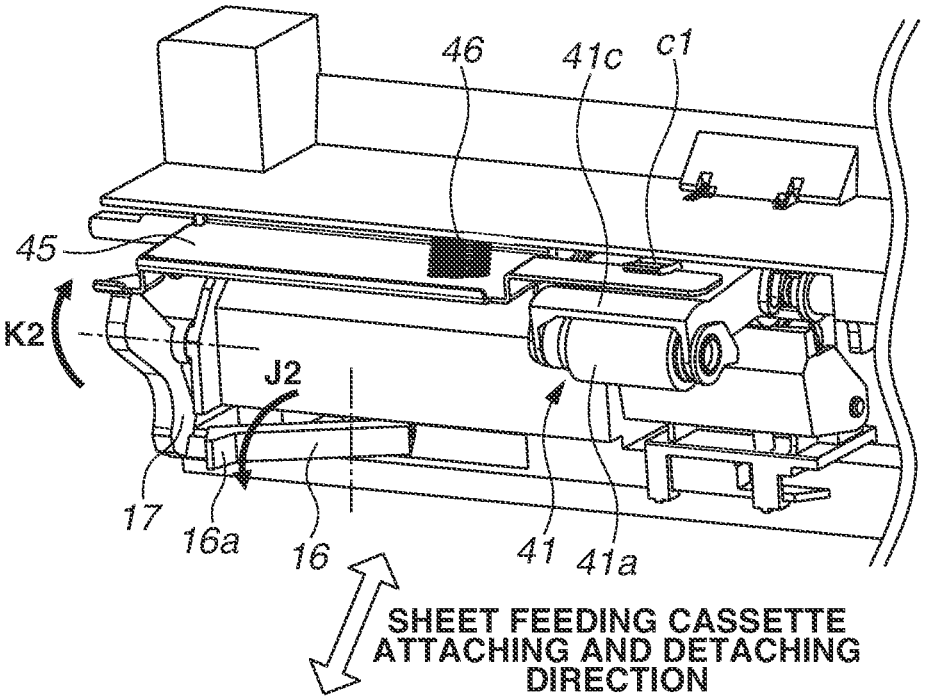
Figure 7:
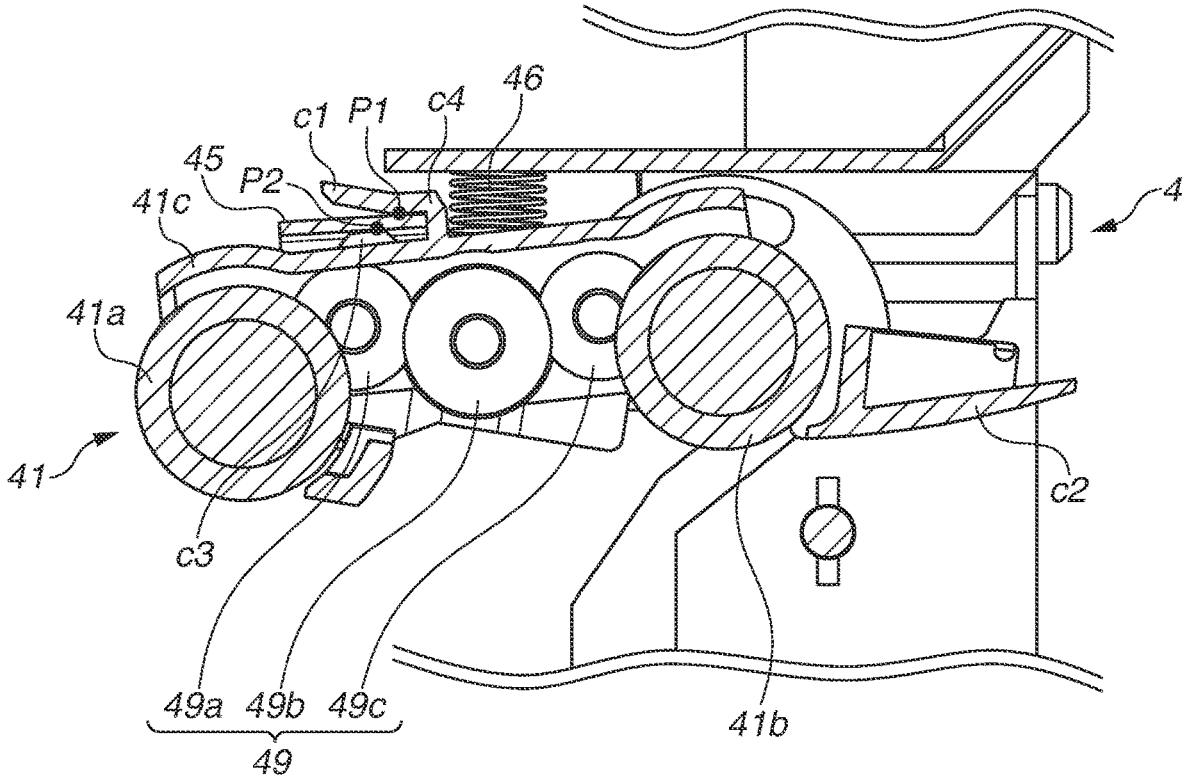
FIG. 7 is a schematic cross-sectional view of the rotation member unit viewed along the sheet conveyance direction according to the first embodiment.

Next, switching of orientations of the rotation member unit 41 is described with reference to FIGS. 6A, 6B, and 7. FIG. 6A is a schematic diagram illustrating an orientation of the rotation member unit 41 when the feeding roller 41*a* can feed the sheet S stored in the sheet feeding cassette 3. FIG. 6B is a schematic diagram illustrating an orientation of the rotation member unit 41 when the feeding roller 41*a* is not in contact with the sheet S stored in the sheet feeding cassette 3 and does not feed the sheet S. FIGS. 6A and 6B are schematic diagrams viewed from the direction shown by the arrow B in FIG. 1. FIG. 7 is an enlarged cross-sectional view of the rotation member unit 41 viewed along the sheet conveyance direction.

As illustrated in FIG. 7, the holder 41*c* includes the claw portion c1 as the engaging portion for engaging with the feeding roller arm 45 and an abutment portion c3 for abutting on the feeding roller arm 45. The claw portion c1 and the abutment portion c3 are brought into contact with the feeding roller arm 45 respectively at a contacting portion P1 and a contacting portion P2, and the rotation member unit 41 is held by the feeding roller arm 45 in a state in which forces are balanced at the respective contacting portions.

As illustrated in FIGS. 6A and 6B, the orientation of the feeding roller arm 45 can be changed by a first control lever 16 and a second control lever 17. The first control lever 16 and the second control lever 17 are turnably arranged to the frame 22 by a supporting shaft, not illustrated, and turning axial lines of the first control lever 16 and the second control lever 17 are respectively shown in FIGS. 6A and 6B by alternate long and short dash lines. When the sheet feeding cassette 3 is attached to the main body 2, as illustrated in FIG. 6A, an abutment surface 16*a* of the first control lever 16 is pressed by the sheet feeding cassette 3, and the first control lever 16 turns to a direction shown by an arrow J1. When the first control lever 16 turns to the direction shown by the arrow J1, the second control lever 17 is pressed and turns to a direction shown by an arrow K1. When the second control lever 17 turns, the feeding roller arm 45 comes into an orientation shown in FIG. 6A by the urging force of the spring 46. At that time, the rotation member unit 41 supported by the feeding roller arm 45 is moved to a position at which the feeding roller 41*a* can abut on the sheet S stored in the sheet feeding cassette 3 and thus comes into an orientation capable of feeding the sheet S.

On the other hand, when the sheet feeding cassette 3 is not attached to the main body 2, as illustrated in FIG. 6B, the first control lever 16 turns to a direction shown by an arrow J2 by an urging spring, not illustrated, and the second control lever 17 turns to a direction shown by an arrow K2. The direction shown by the arrow J2 is a direction opposite to the direction shown by the arrow J1 in FIG. 6A, and the direction shown by the arrow K2 is a direction opposite to the direction shown by the arrow K1 in FIG. 6A. The urging spring, not illustrated, has an urging force greater than a weight of the feeding roller arm 45 and the urging force of the spring 46, and the feeding roller arm 45 comes into an orientation shown in FIG. 6B by the second control lever 17 urged by this urging force. At that time, the rotation member unit 41 held by the feeding roller arm 45 is moved to a position not disturbing attachment of the sheet feeding cassette 3.

[Attaching or Detaching Method of Rotation Member Unit]

Figure 8:
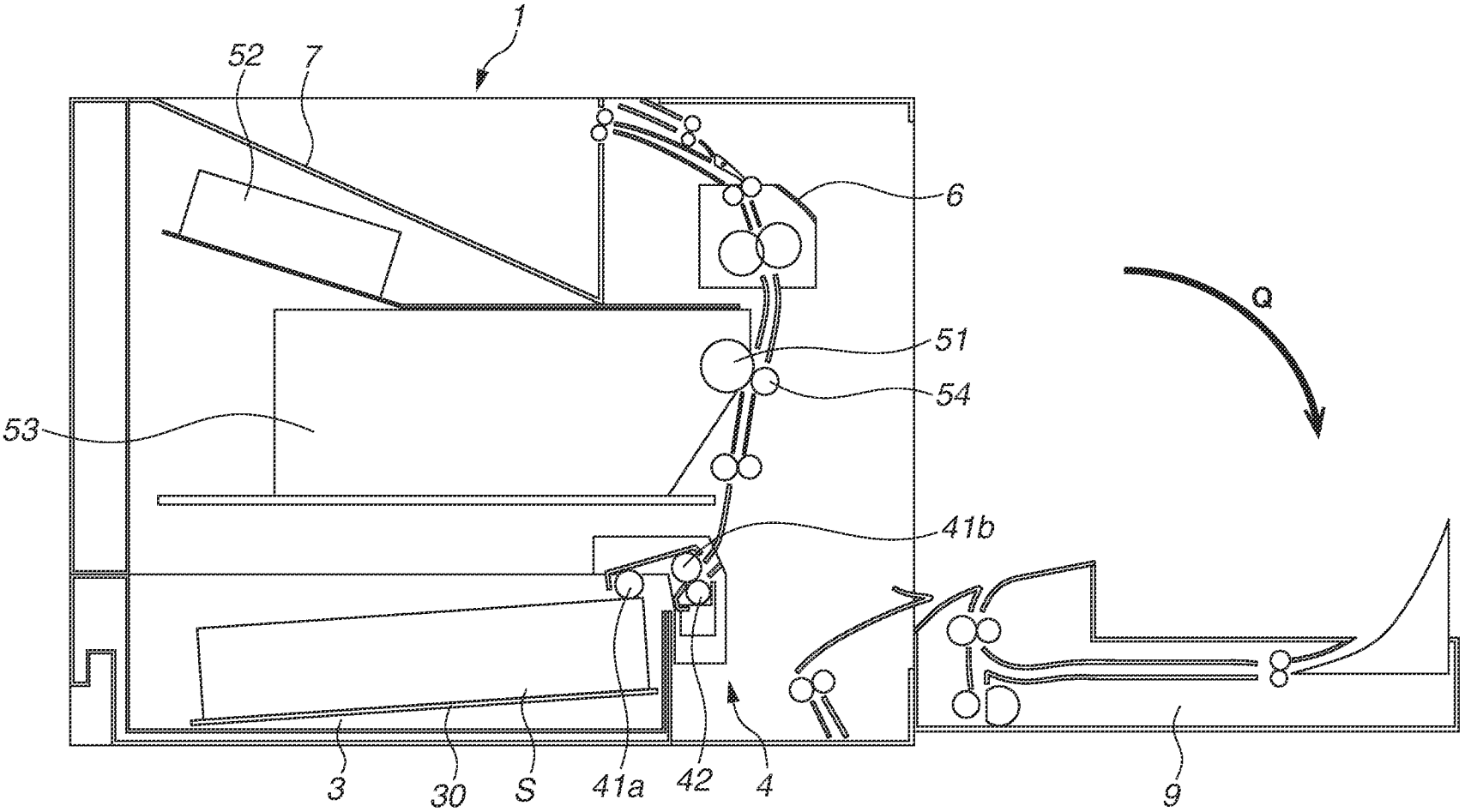
FIG. 8 is a schematic cross-sectional view illustrating a state in which an access door as an opening and closing member is opened in the image forming apparatus according to the first embodiment.

Next, a method for attaching or detaching the rotation member unit 41 is described with reference to FIGS. 6B, 7 to 10A, and 10B. FIG. 8 is a schematic cross-sectional view illustrating a state in which an access door 9 as an opening and closing member of the image forming apparatus 1 is opened. As illustrated in FIG. 8, when the rotation member unit 41 is attached and detached, the access door 9 disposed on the main body 2 of the image forming apparatus 1 is opened to a direction shown by an arrow Q, and thus the separation unit 43 and the rotation member unit 41 can be viewed. When the access door 9 is opened, processing when a jam of the sheet S occurs and maintenance of the image forming unit 5 in the image forming apparatus 1 can be performed.

When the rotation member unit 41 is attached and detached, a user first pulls out the sheet feeding cassette 3 from the main body 2 and moves the rotation member unit 41 to a position illustrated in FIG. 6B. Subsequently, as illustrated in FIG. 8, the user opens the access door 9 openably and closably provided to the main body 2, and thus the separation unit 43 and the rotation member unit 41 attached to the feeding unit 4 are put into a viewable state.

Attaching or detaching of the rotation member unit 41 by a user are performed using following procedures. First, a procedure for detaching the rotation member unit 41 from the feeding unit 4 is described with reference to FIGS. 9A to 9D.

Figure 9A:
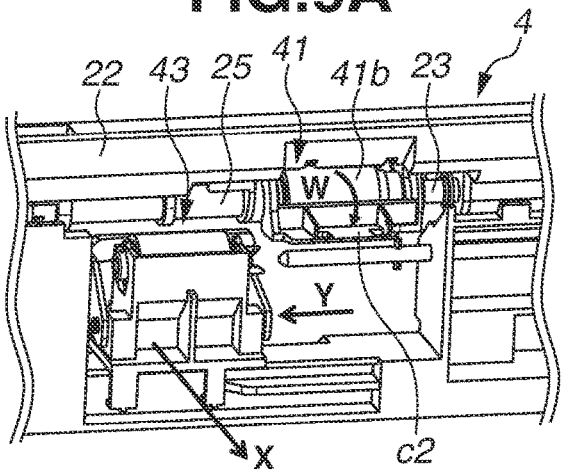
FIGS. 9A to 9D are schematic diagrams illustrating operations when the rotation member unit is detached from the feeding unit according to the first embodiment.

FIG. 9A is a schematic diagram illustrating a state of the feeding unit 4 when a position of the separation unit 43 is moved to detach the rotation member unit 41. As illustrated in FIG. 9A, according to the present embodiment, first, the separation unit 43 attached to the frame 22 is moved to a direction shown by an arrow Y when the rotation member unit 41 is attached and detached. Subsequently, the separation unit 43 is pulled out to a direction shown by an arrow X intersecting the direction shown by the arrow Y, and thus the separation unit 43 is removed from the frame 22. Further, the guide portion c2 held by the frame 22 is turned to a direction shown by an arrow W to detach the rotation member unit 41. Accordingly, the user can grip the guide portion c2.

Figure 9B:
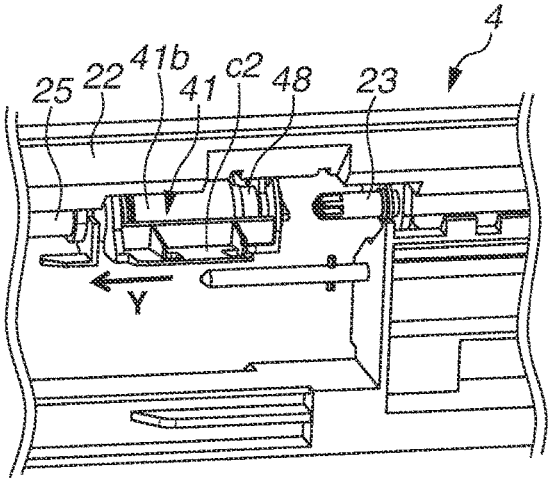

FIG. 9B is a schematic diagram illustrating a state of the feeding unit 4 when the rotation member unit 41 is moved to a direction from the coupling shaft 23 toward the slide shaft 25 (the direction shown by the arrow Y) with respect to an axial direction of the coupling shaft 23. As illustrated in FIG. 9B, when the user grips and moves the guide portion c2 of the rotation member unit 41 to the direction shown by the arrow Y, the slide shaft 25 provided movably in the axial direction is moved to the direction shown by the arrow Y in association with the movement of the rotation member unit 41. The slide shaft 25 is moved for a predetermined distance and then locked by a locking unit at a position after the movement. A moving operation of the slide shaft 25 and the locking unit of the slide shaft 25 are described in detail below.

In a state illustrated in FIG. 9B, the rotation member unit 41 is moved to the direction shown by the arrow Y, and accordingly engagement between the engaging groove 48*a* of the conveyance gear 48 and the coupling shaft 23 is released, and the conveyance roller 41*b* is in a state of not being rotatably supported by the coupling shaft 23.

Figure 9C:
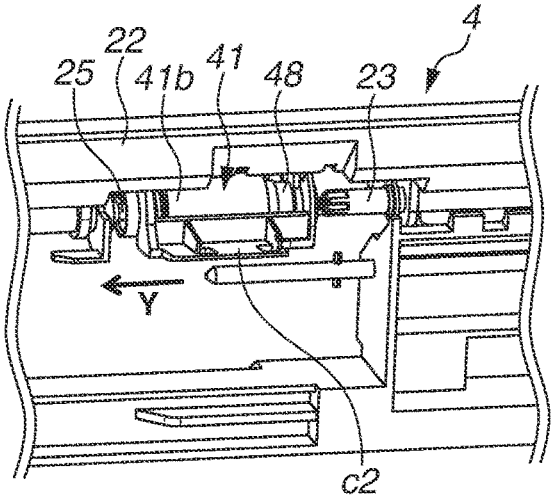

FIG. 9C is a schematic diagram illustrating a state of the feeding unit 4 when the rotation member unit 41 is moved to a direction opposite to the direction shown by the arrow Y, and engagement between the slide shaft 25 and the conveyance roller 41*b* is released. As illustrated in FIG. 9C, when the user moves the rotation member unit 41 in a state of gripping the guide portion c2 to the direction opposite to the direction shown by the arrow Y for a distance corresponding to that the slide shaft 25 rotatably supports the conveyance roller 41*b*, engagement between the slide shaft 25 and the engaging hole b1 of the conveyance roller 41*b* is released. Accordingly, the conveyance roller 41*b* comes into a state of not being rotatably supported by the slide shaft 25, and the rotation member unit 41 comes into a state of not being supported by the coupling shaft 23 and the slide shaft 25.

As illustrated in FIG. 7, the claw portion c1 formed on the holder 41*c* engages with the feeding roller arm 45, and the abutment portion c3 abuts on the feeding roller arm 45 in the rotation member unit 41 at that time. In this state, the rotation member unit 41 tends to move downward in the vertical direction by its own weight but is in a balanced state since the claw portion c1 and the abutment portion c3 are in contact with the feeding roller arm 45 respectively at the contacting portion P1 and the contacting portion P2. Accordingly, the rotation member unit 41 is held by the feeding roller arm 45 provided to the frame 22, and if the user releases his/her hand from the guide portion c2, the rotation member unit 41 does not fall in the feeding unit 4 and the like. As described above, according to the present embodiment, a state in which the rotation member unit 41 does not fall in the feeding unit 4 when the user releases his/her hand from the rotation member unit 41 is regarded as a state in which the rotation member unit 41 is held. According to the present embodiment, the abutment portion c3 is provided to abut on the feeding roller arm 45, however, the claw portion c1 and the holder 41*c* may be brought into contact with the feeding roller arm 45 without providing the abutment portion c3.

Figure 9D:
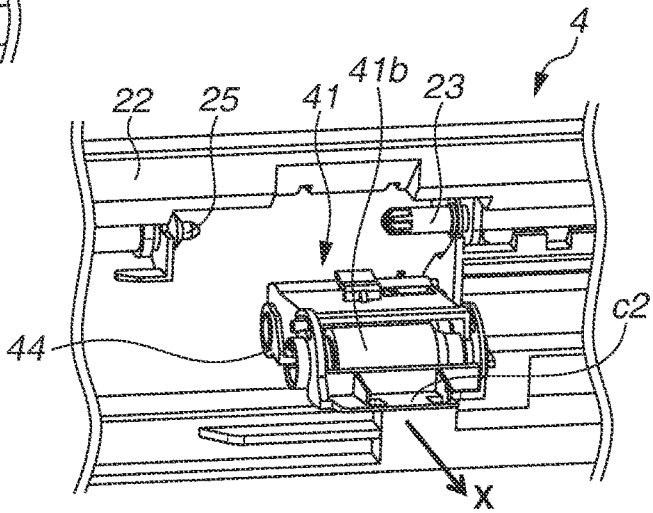

FIG. 9D is a schematic diagram illustrating a state of the feeding unit 4 when the rotation member unit 41 is detached from the feeding unit 4. As illustrated in FIG. 9D, a user can detach the rotation member unit 41 from the feeding unit 4 by pulling out the rotation member unit 41 to the direction shown by the arrow X in a state in FIG. 9C in which the rotation member unit 41 is not supported by the coupling shaft 23 and the slide shaft 25. At that time, the feeding roller 41*a*, the conveyance roller 41*b*, and the detection member 44 are integrated as the rotation member unit 41, and thus, when the rotation member unit 41 is detached, these components can be replaced at the same time.

Thus, the user can easily detach the rotation member unit 41 while gripping the guide portion c2 in one hand by the above-described procedure. Next, a procedure for attaching the rotation member unit 41 to the feeding unit 4 is described with reference to FIGS. 10A and 10B.

Figure 10A:
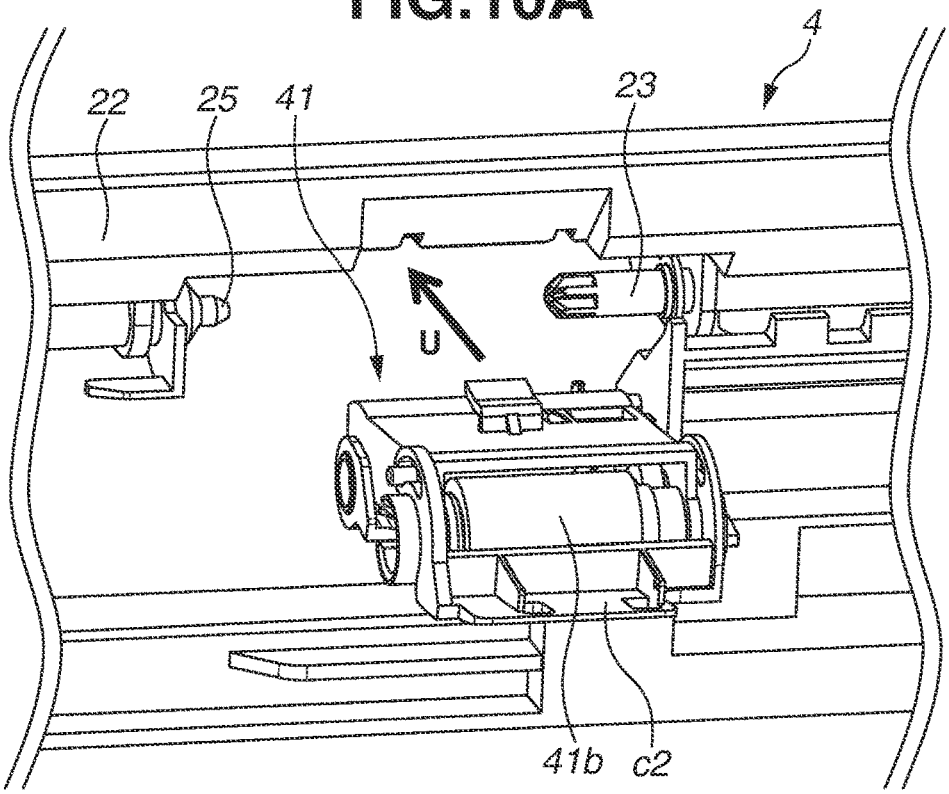
FIGS. 10A and 10B are schematic diagrams illustrating operations when the rotation member unit is attached to the feeding unit according to the first embodiment.

FIG. 10A is a schematic diagram illustrating a state of the feeding unit 4 when the rotation member unit 41 is attached to the feeding unit 4. As illustrated in FIG. 10A, a user inserts the rotation member unit 41 into the feeding unit 4 toward a direction shown by an arrow U while gripping the guide portion c2 of the rotation member unit 41. The direction shown by the arrow U is a direction intersecting the axial direction of the coupling shaft 23 and a direction opposite to the direction shown by the arrow X in FIG. 9D. At that time, the slide shaft 25 is locked in the state of being moved in the above-described detaching process of the rotation member unit 41, and thus the slide shaft 25 will not be an obstacle when the rotation member unit 41 is inserted to the direction shown by the arrow U.

In a process of inserting the rotation member unit 41 into the feeding unit 4, the claw portion c1 formed on the holder 41*c* engages with the feeding roller arm 45 as illustrated in FIG. 7. The claw portion c1 has a regulation surface c4, and the user inserts the rotation member unit 41 into the feeding unit 4 until the regulation surface c4 abuts on the feeding roller arm 45 after the claw portion c1 engages with the feeding roller arm 45. The claw portion c1 abuts on the feeding roller arm 45, and thus the rotation member unit 41 cannot move further toward the feeding roller arm 45 from a position at which the regulation surface c4 abuts on the feeding roller arm 45 and is regulated in movement in the direction shown by the arrow U. In other words, the user inserts the rotation member unit 41 into a position at which the rotation member unit 41 cannot move further toward the direction shown by the arrow U in FIG. 10A. At that time, the rotation member unit 41 is held by the feeding roller arm 45 in a state in which the conveyance roller 41*b*, the coupling shaft 23, and the slide shaft 25 are aligned on approximately the same axial line.

Figure 10B:
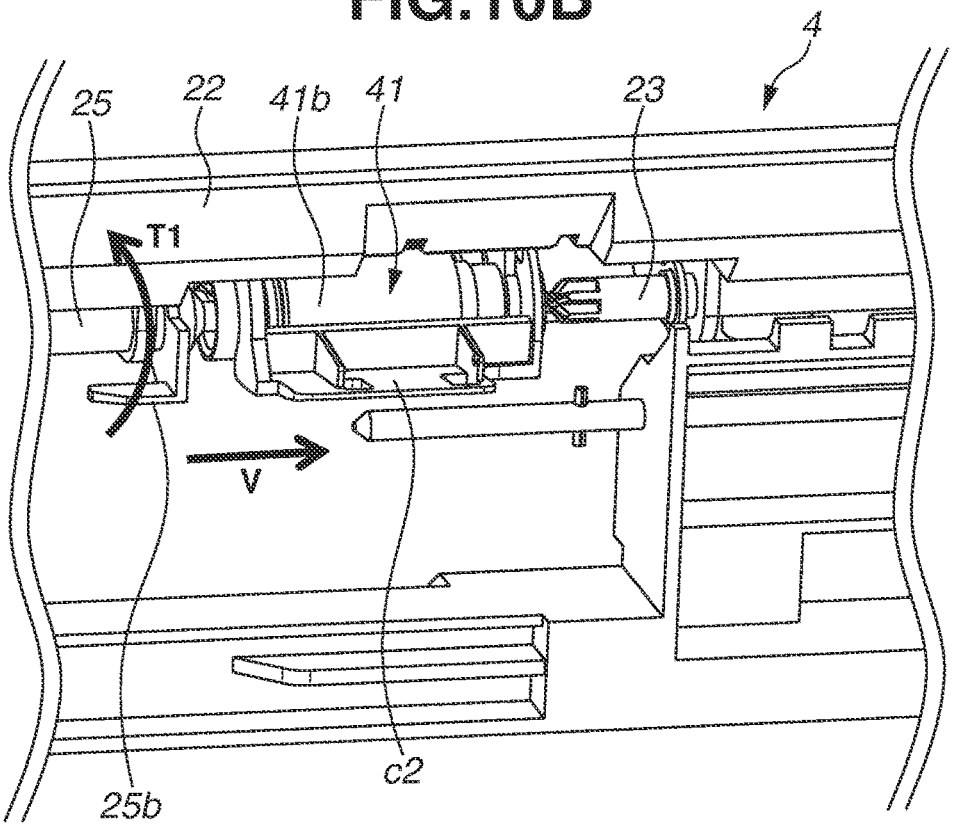

FIG. 10B is a schematic diagram illustrating a state of the feeding unit 4 when the rotation member unit 41 is held by the feeding roller arm 45. In this state, the rotation member unit 41 is held to the feeding roller arm 45 by the engaging portion c1 and the abutment portion c3 as illustrated in FIG. 7, and if the user releases his/her hand from the guide portion c2, the rotation member unit 41 does not fall in the feeding unit 4 and the like.

When the user releases his/her hand from the guide portion c2 in a state in FIG. 10B and turns a projecting portion 25*b* provided to the slide shaft 25 in a direction shown by an arrow T1, the lock of the slide shaft 25 by the locking unit, described below, is released, and the slide shaft 25 is moved to a direction shown by an arrow V. When the slide shaft 25 is moved to the direction shown by the arrow V, the slide shaft 25 engages with the engaging hole b1 of the conveyance roller 41*b* and rotatably supports the conveyance roller 41*b*. Further, the conveyance roller 41*b* is pushed by the slide shaft 25 and moved toward the coupling shaft 23 in the direction shown by the arrow V, and the engaging groove 48*a* of the conveyance gear 48 disposed on the rotation axis line of the conveyance roller 41*b* engages with the coupling shaft 23. Accordingly, the conveyance roller 41*b* is rotatably supported by the coupling shaft 23 and the slide shaft 25, and the rotation member unit 41 is supported by the coupling shaft 23 and the slide shaft 25.

Further, the guide portion c2 is held by the snap fit, not illustrated, with respect to the frame 22 in a state in which the rotation member unit 41 is supported by the coupling shaft 23 and the slide shaft 25, and thus the attachment of the rotation member unit 41 to the feeding unit 4 is completed. When the conveyance roller 41*b* is moved in the direction shown by the arrow V by releasing the lock of the slide shaft 25, the claw portion c1 is moved in the direction shown by the arrow V together with the movement of the conveyance roller 41*b* while maintaining the engagement with the feeding roller arm 45.

Subsequently, the user attaches the separation unit 43 to the feeding unit 4 by a procedure the reverse of the procedure for detaching the separation unit 43 and closes the access door 9 being opened, and thus the replacement of the rotation member unit 41 in the image forming apparatus 1 is completed.

As described above, according to the present embodiment, the claw portion c1 as the engaging portion provided to the holder 41*c* of the rotation member unit 41 engages with the feeding roller arm 45 as the engaged portion provided to the frame 22 of the feeding unit 4. Accordingly, the rotation member unit 41 is held by the feeding roller arm 45 provided to the frame 22 even in a state in which the rotation member unit 41 is not supported by the coupling shaft 23 and the slide shaft 25. Therefore, if a user releases his/her hand from the rotation member unit 41 when attaching or detaching the rotation member unit 41 to and from the feeding unit 4, the rotation member unit 41 does not fall in the feeding unit 4 and the like, and an attaching/detaching property of the rotation member unit 41 with respect to the feeding unit 4 can be refined.

Further, according to the present embodiment, the coupling shaft 23, the conveyance roller 41*b*, and the slide shaft 25 are designed to be aligned on approximately the same axial line when the regulation surface c4 of the claw portion c1 abuts on the feeding roller arm 45. Accordingly, a user can place the rotation member unit 41 on a position at which the engaging groove 48*a* of the conveyance gear 48 and the engaging hole b1 of the conveyance roller 41*b* can respectively engage with the coupling shaft 23 and the slide shaft 25 by only an insertion operation of the rotation member unit 41.

According to the present embodiment, the rotation member unit 41 is attached and detached after completely removing the separation unit 43 from the frame 22 of the feeding unit 4. However, without limited to the above-described configuration, the rotation member unit 41 may be attached and detached by moving the separation unit 43 to the direction shown by the arrow Y and in a state in which the feeding unit 4 holds the separation unit 43 as illustrated in FIG. 9A without completely removing the separation unit 43 from the feeding unit 4. In this case, the separation unit 43 may be moved in the direction shown by the arrow Y to a position at which the separation unit 43 does not overlap with a space necessary for attaching or detaching the rotation member unit 41.

Further, according to the present embodiment, the holder 41*c* of the rotation member unit 41 is provided with the guide portion c2 which can be gripped by a user, however, the guide portion c2 may not be provided without limited to the above-described configuration. In this case, a user can perform attaching or detaching operations of the rotation member unit 41 by gripping the holder 41*c*.

[Locking Unit of Slide Shaft]

Next, the locking unit for locking the slide shaft 25 to the frame 22 is described with reference to FIGS. 11A to 11D. FIGS. 11A to 11D are schematic diagrams illustrating components to describe the locking unit of the slide shaft 25.

Figure 11A:
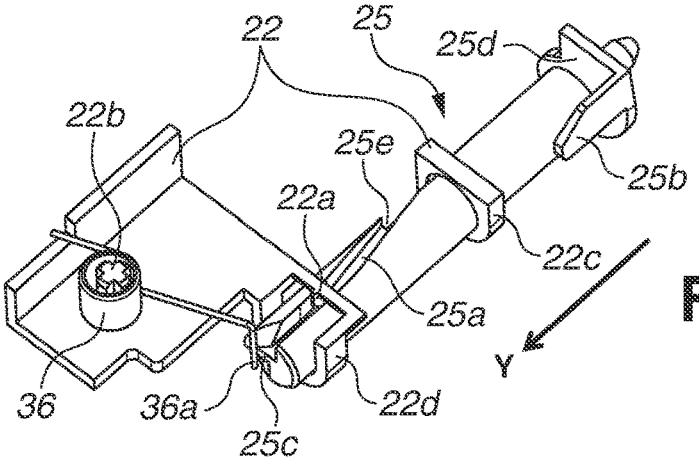
FIGS. 11A to 11D are schematic diagrams illustrating a locking unit of the moving shaft according to the first embodiment.

FIG. 11A is a schematic diagram illustrating a state of the slide shaft 25 before a user moves the rotation member unit 41 to the direction shown by the arrow Y. According to the present embodiment, a position of the slide shaft 25 before the rotation member unit 41 is moved to the direction shown by the arrow Y is referred to as an initial position (a first position). In the state illustrated in FIG. 11A, the slide shaft 25 rotatably supports the conveyance roller 41*b* at the initial position, and the rotation member unit 41 is supported by the coupling shaft 23 and the slide shaft 25.

As illustrated in FIG. 11A, the frame 22 includes a protrusion portion 22*a* for engaging with a groove portion 25*a* provided to the slide shaft 25 and a holding portion 22*b* for holding an urging spring 36 (a first urging member) for urging the slide shaft 25. The frame 22 further includes a support portion 22*c* for supporting the slide shaft 25 movably and turnably in the direction shown by the arrow Y and a support portion 22*d*. The urging spring 36 includes a pressing portion 36*a* for pressing the slide shaft 25.

The slide shaft 25 includes the groove portion 25*a*, the projecting portion 25*b*, a pressed surface 25*c* to be pressed by the pressing portion 36*a* of the urging spring 36, and a regulation portion 25*d* which can regulate a movement of the slide shaft 25 to an axial direction. The pressing portion 36*a* of the urging spring 36 presses the pressed surface 25*c*, and thus the slide shaft 25 is urged toward the rotation member unit 41. The groove portion 25*a* is formed to extend and twist in the axial direction of the slide shaft 25. Further, a regulation surface 25*e* is formed in the groove portion 25*a* of the slide shaft 25 for regulating a movement of the slide shaft 25 in the axial direction when the slide shaft 25 is locked.

When a user moves the rotation member unit 41 to the direction shown by the arrow Y to detach the rotation member unit 41 from the feeding unit 4, the slide shaft 25 is pressed by the rotation member unit 41 and moved to the direction shown by the arrow Y. At that time, the pressing portion 36*a* of the urging spring 36 is pressed to a direction opposite to an urging direction of the urging spring 36 by the pressed surface 25*c* of the slide shaft 25.

Figure 11B:
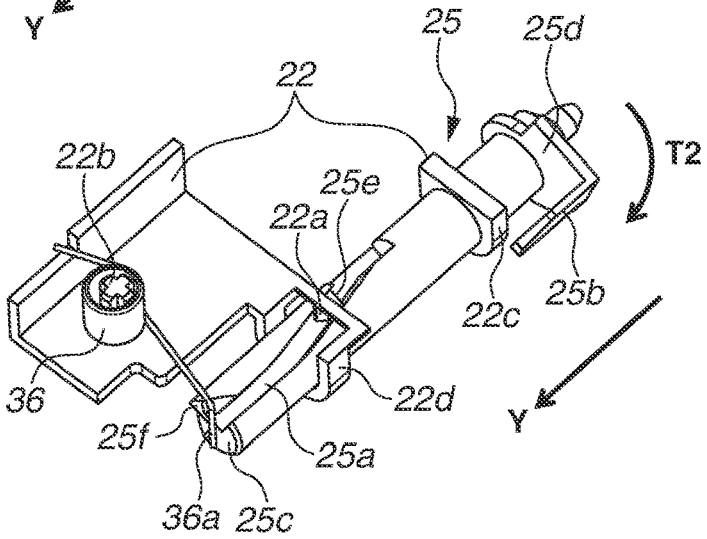

FIG. 11B is a schematic diagram illustrating a state of the slide shaft 25 when the slide shaft 25 is moved to the direction shown by the arrow Y. In this state, the slide shaft 25 is moved to the direction shown by the arrow Y which is a direction against to an urging force of the urging spring 36 while rotating in a direction shown by an arrow T2 along a twist direction of the groove portion 25*a* and maintaining engagement between the protrusion portion 22*a* and the groove portion 25*a*.

Figure 11C:
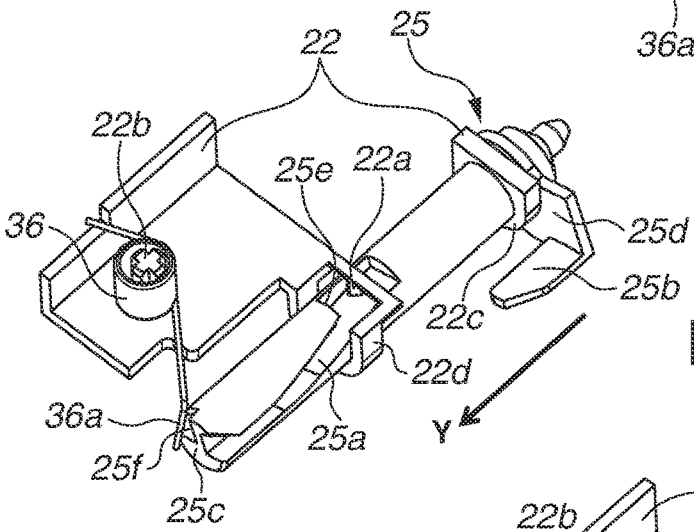

FIG. 11C is a schematic diagram illustrating a state of the slide shaft 25 when the regulation portion 25*d* of the slide shaft 25 is brought into contact with the support portion 22*c* of the frame 22. As illustrated in FIG. 11C, when the slide shaft 25 is moved to the direction shown by the arrow Y, and the regulation portion 25*d* is brought into contact with the support portion 22*c*, the slide shaft 25 cannot move any further. At that time, the pressing portion 36*a* of the urging spring 36 is moved to a position facing an engaging groove 25*f* provided to the slide shaft 25.

Figure 11D:
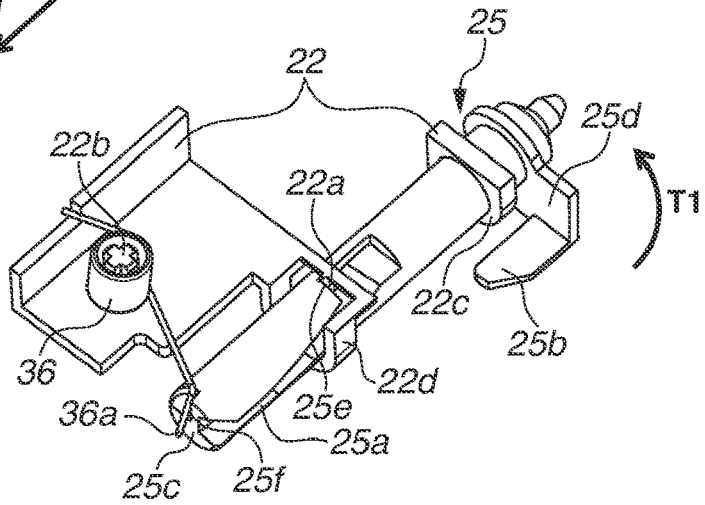
Figure 12:
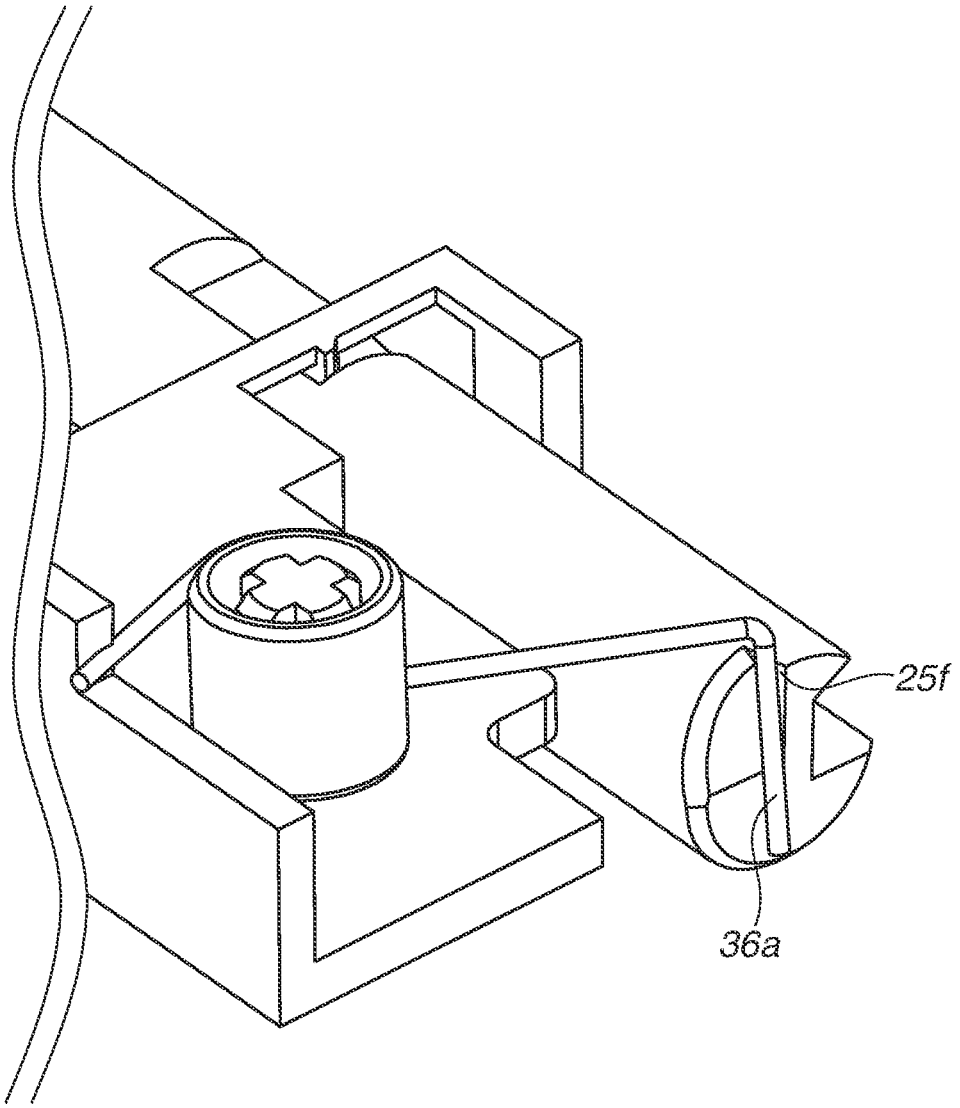
FIG. 12 is a schematic diagram illustrating engagement between the moving shaft and an urging member according to the first embodiment.

FIG. 11D is a schematic diagram illustrating a state of the slide shaft 25 when the slide shaft 25 is locked. According to the present embodiment, a position of the slide shaft 25 at that time is referred to as a locking position (a second position). FIG. 12 is a schematic diagram illustrating an engagement state of the pressing portion 36*a* of the urging spring 36 and the engaging groove 25*f* of the slide shaft 25.

In the state illustrated in FIG. 11C, the slide shaft 25 is moved to a direction opposite to the direction shown by the arrow Y by being pressed by the pressing portion 36*a* of the urging spring 36, and then, the protrusion portion 22*a* abuts on the regulation surface 25*e*. As illustrated in FIG. 11D, in a state in which the protrusion portion 22*a* engages with the groove portion 25*a* and is regulated by the regulation surface 25*e*, the slide shaft 25 cannot move any further by being regulated in movement and is locked at the locking position. In addition, the pressing portion 36*a* engages with the engaging groove 25*f* at that time as illustrated in FIG. 12, and thus the slide shaft 25 is regulated in rotation. As described above, according to the present embodiment, the slide shaft 25 is locked at the locking position illustrated in FIG. 11D by the locking unit constituted of the protrusion portion 22*a* provided to the frame 22 and the groove portion 25*a* provided to the slide shaft 25.

When the rotation member unit 41 is held by the feeding roller arm 45, and the lock of the slide shaft 25 is released, a user turns the projecting portion 25*b* to the direction shown by the arrow T1 as illustrated in FIGS. 10B and 11D. Accordingly, the pressing portion 36*a* of the urging spring 36 gets across the engaging groove 25*f* and, the protrusion portion 22*a* comes into a state of not being regulated by the regulation surface 25*e*. Further, the pressing portion 36*a* presses the pressed surface 25*c* by the urging force of the urging spring 36, and the protrusion portion 22*a* starts to move in a direction opposite to the direction shown by the arrow Y in FIG. 11A along the groove portion 25*a*. Accordingly, the slide shaft 25 is moved from the locking position to the initial position. At that time, the protrusion portion 22*a* is moved along the twist direction of the groove portion 25*a*, and thus the slide shaft 25 is moved to a position at which the slide shaft 25 engages with the engaging hole b1 of the conveyance roller 41*b* while rotating in the direction shown by the arrow T1.

As described above, according to the present embodiment, the rotation member unit 41 is moved to a position not supported by the coupling shaft 23 with respect to the axial direction of the coupling shaft 23, and thus the slide shaft 25 is moved from the initial position to the locking position against the urging force of the urging spring 36. Then, the slide shaft 25 is locked at the locking position by the locking unit. As described above, since the slide shaft 25 is provided with the locking unit, the slide shaft 25 can be maintained in a state of being locked at the locking position when a user attaches and detaches the rotation member unit 41, and thus the attaching or detaching operations of the rotation member unit 41 can be performed in a wider space. Accordingly, the attaching/detaching property of the rotation member unit 41 can be refined.

Further, according to the present embodiment, the rotation member unit 41 is moved in the axial direction of the coupling shaft 23, and thus the slide shaft 25, which is not connected to the motor M as the driving source, can be moved from the initial position to the locking position. In other words, the configuration according to the present embodiment does not move the coupling shaft 23 connected to the motor M. When the coupling shaft connected to be transmitted with driving of the driving source is moved, it is necessary to move a member for transmitting driving simultaneously with the movement of the coupling shaft. In addition, it is necessary to provide a plurality of transmission routes for transmitting driving from the driving source to the coupling shaft and switch the transmission routes according to a movement position of the coupling shaft. However, in this case, the configuration may be complicated and increase a cost and a size of the apparatus. In contrast, in the configuration according to the present embodiment, the slide shaft 25, which is not connected to the motor M as the driving source, is moved, and thus the attaching/detaching property of the rotation member unit 41 can be refined with a simple configuration.

Further, according to the present embodiment, the slide shaft 25 is moved from the initial position to the locking position and locked at the locking position by the operation for moving the rotation member unit 41. In other words, there is no need for a user to move and lock the slide shaft 25 by his/her hand, and the slide shaft 25 can be moved and locked by only an operation for moving the rotation member unit 41 when the rotation member unit 41 is detached. Further, when the rotation member unit 41 is attached, the lock of the slide shaft 25 can be released by only an operation for turning the projecting portion 25*b*, and the slide shaft 25 can be moved from the locking position to the initial position. By the operation for releasing the lock of the slide shaft 25, the rotation member unit 41 is supported by the coupling shaft 23 and the slide shaft 25. As described above, the configuration according to the present embodiment can refine the attaching/detaching property of the rotation member unit 41.

According to the present embodiment, if it is tried to attach the separation unit 43 to the feeding unit 4 in a state in which the lock of the slide shaft 25 is not released, the projecting portion 25*b* of the slide shaft 25 interferes with the separation unit 43, and it is difficult to attach the separation unit 43. Accordingly, the separation unit 43 can be suppressed from being erroneously attached in a state in which the rotation member unit 41 is not completely attached to the feeding unit 4. However, the present embodiment is not limited to the above-described configuration and may adopt a configuration in which, for example, a user does not turn the projecting portion 25*b* of the slide shaft 25, and the lock of the slide shaft 25 is released when the separation unit 43 is brought into contact with the projecting portion 25*b* in an attaching operation of the separation unit 43. Accordingly, the lock of the slide shaft 25 can be released by such a simple configuration, and the separation unit 43 can be suppressed from being erroneously attached in a state in which the rotation member unit 41 is not completely attached to the feeding unit 4.

According to the present embodiment, the feeding roller 41*a*, the conveyance roller 41*b*, and the separation roller 42 are respectively constituted of rollers, however, may be constituted of a rotation member such as a belt without limited to the above-described configuration.

Further, according to the present embodiment, the configuration is described in which the coupling shaft 23 engages with the conveyance gear 48, the slide shaft 25 engages with the engaging hole b1, and thus the rotation member unit 41 is supported by the coupling shaft 23 and the slide shaft 25. However, the present embodiment is not limited to the above-described configuration and may include a gear which can transmit a driving force to the feeding gear 47 and the conveyance gear 48 and engage with the coupling shaft 23 and an engaging portion which can engage with the slide shaft 25 in the holder 41*c* of the rotation member unit 41. In such a configuration, the rotation member unit 41 can be supported by the coupling shaft 23 and the slide shaft 25.

According to the present embodiment, the configuration is described in which the conveyance roller 41*b* is pushed by the slide shaft 25 to a direction toward the coupling shaft 23 when the lock of the slide shaft 25 is released, and the rotation member unit 41 is supported by the coupling shaft 23 and the slide shaft 25. However, the present embodiment is not limited to the above-described configuration and, for example, the rotation member unit 41 may be moved by a user to a position to be supported by the coupling shaft 23 in a state in which the claw portion c1 of the rotation member unit 41 engages with the feeding roller arm 45, and then the lock of the slide shaft 25 may be released. In such a configuration, the slide shaft 25 is moved from the locking position to the initial position when the lock of the slide shaft 25 is released, and thus the rotation member unit 41 can be supported by the coupling shaft 23 and the slide shaft 25.

Further, according to the present embodiment, the configuration is described in which the claw portion c1 as the engaging portion provided to the holder 41*c* engages with the feeding roller arm 45 as the engaged portion provided to the feeding unit 4, however the configuration is not limited to this one. For example, the holder 41*c* or the feeding roller 41*a* may be provided with a groove and a hole as an engaging portion, and the feeding unit 4 may be provided with a sheet metal ant a shaft as an engaged portion which can engage with the groove and the hole provided to the holder 41*c* or the feeding roller 41*a*.

Further, according to the present embodiment, the stacking plate 30 is lifted by a driving force of the motor, not illustrated, however, the stacking plate 30 may be urged toward the feeding roller 41*a* by an urging member such as a spring without providing the driving source such as the motor without limited to the above-described one.

According to the first embodiment, the configuration is described in which the locking unit including the protrusion portion 22*a* provided to the frame 22 and the groove portion 25*a* provided to the slide shaft 25 locks the slide shaft 25 to the locking position. In contrast, according to a second embodiment, a configuration is described in which a locking unit including a groove portion 222*a* provided to a frame 222, a lock rib 225*a* provided to a slide shaft 225, a lock lever 27, and a lever spring 28 locks the slide shaft 225 to a locking position. The configuration according to the present embodiment is similar to that according to the first embodiment excepting the configuration of the locking unit for locking the slide shaft 225 at the locking position, so that the portions similar to those according to the first embodiment are denoted by the same reference numerals, and the descriptions thereof are omitted.

Figure 13:
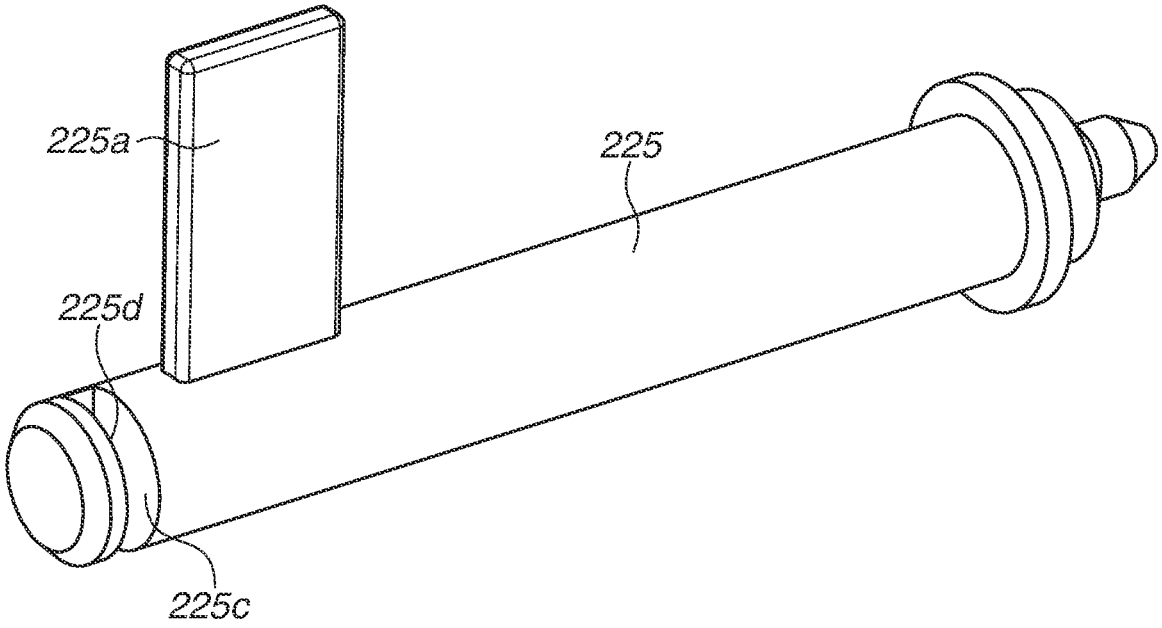
FIG. 13 is a schematic diagram illustrating a configuration of a moving shaft according to a second embodiment.

FIG. 13 is a schematic diagram illustrating a configuration of the slide shaft 225 according to the present embodiment, and as illustrated in FIG. 13, the slide shaft 225 includes the lock rib 225*a* as a protrusion portion, a pressed surface 225*c*, and a regulation portion 225*d*.

Figure 14A:
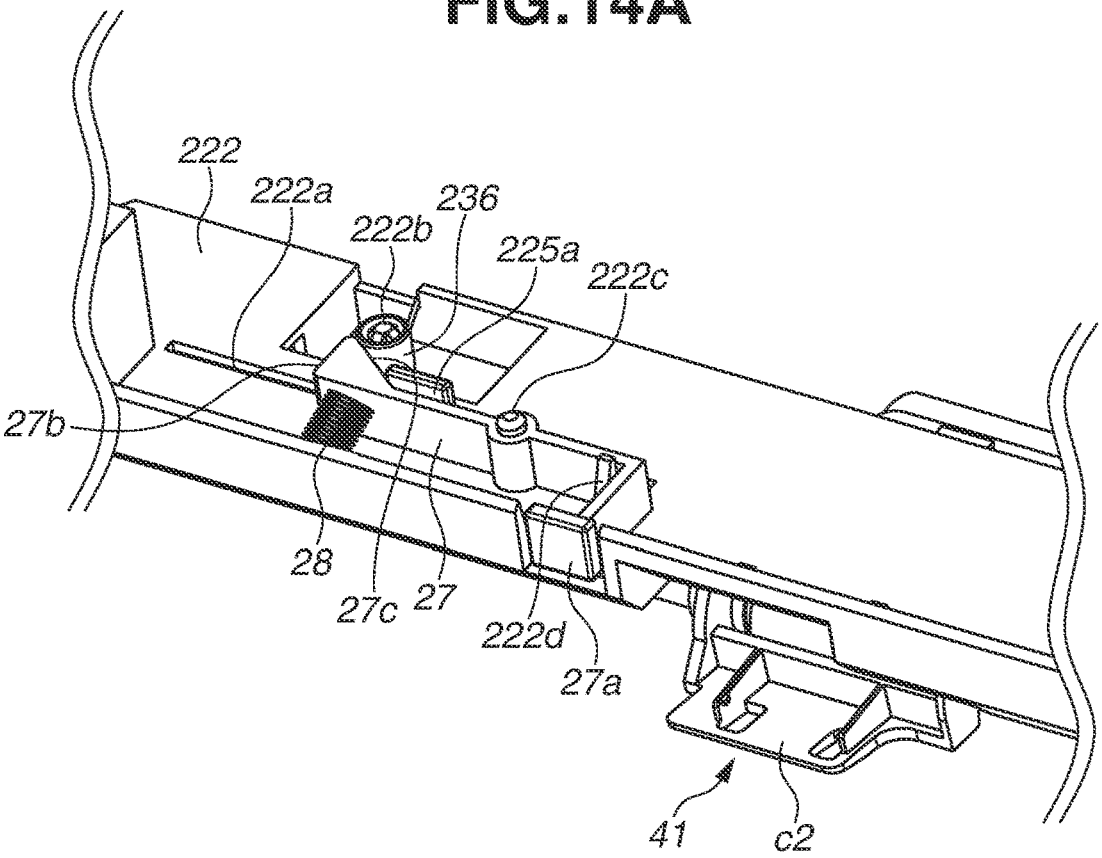
FIGS. 14A and 14B are schematic diagrams illustrating a configuration of a locking unit according to the second embodiment.
Figure 14B:
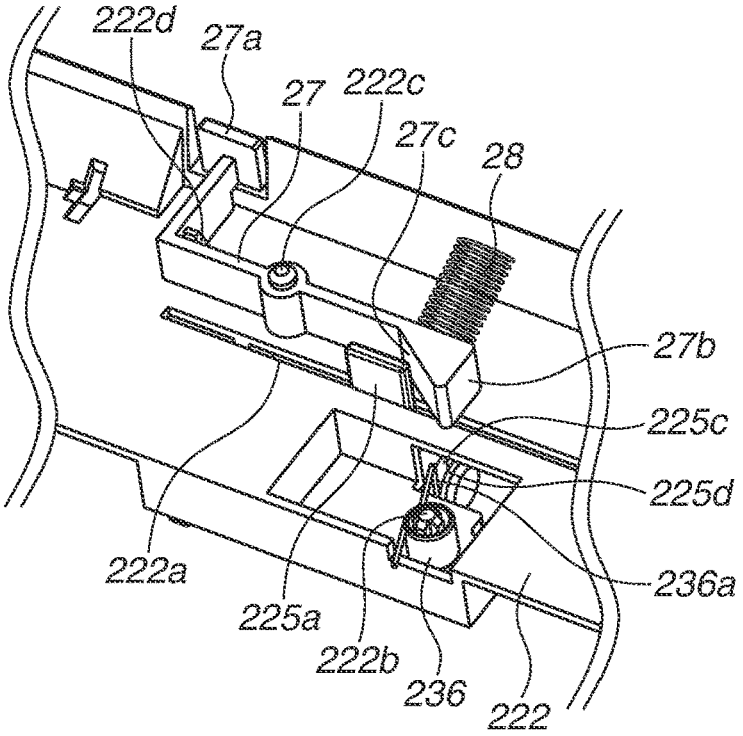
Figure 15A:
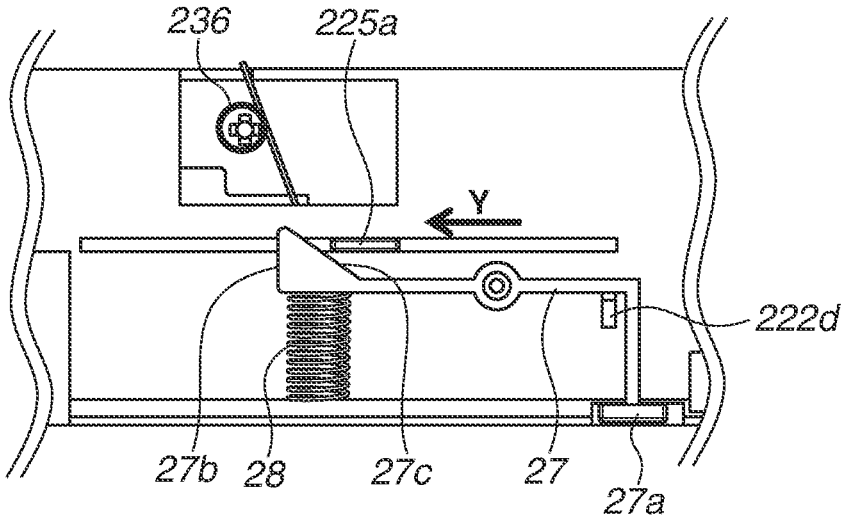
FIGS. 15A to 15C are schematic diagrams illustrating the locking unit of the moving shaft according to the second embodiment.
Figure 15B:
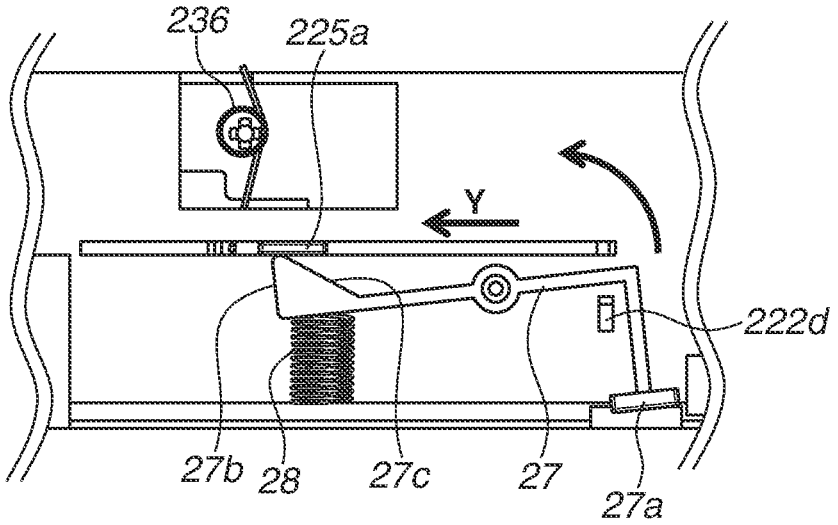
Figure 15C:
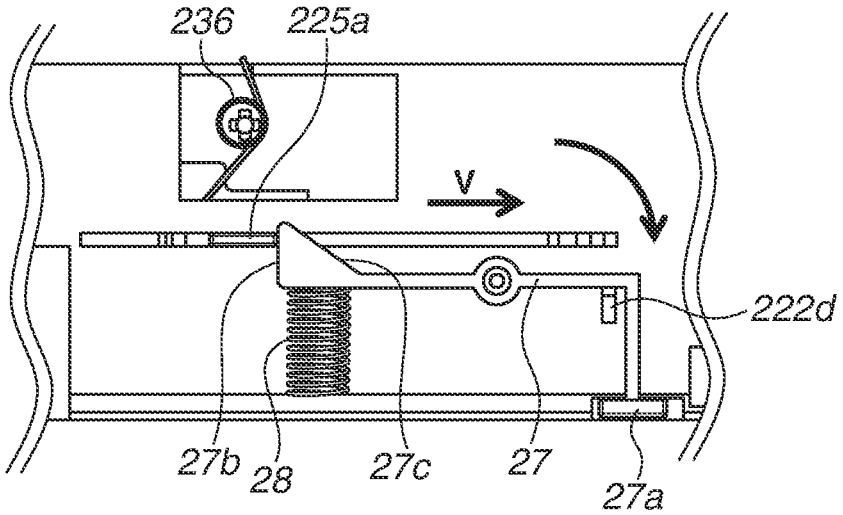

FIG. 14A is a schematic diagram illustrating the locking unit according to the present embodiment viewed from the oblique above of the direction shown by the arrow A in FIG. 1. FIG. 14B is a schematic diagram illustrating the locking unit according to the present embodiment viewed from the oblique above of the direction shown by the arrow B in FIG. 1. FIG. 15A is a schematic diagram illustrating the locking unit before a user moves the rotation member unit 41 to the direction shown by the arrow Y (a direction away from the coupling shaft 23). FIG. 15B is a schematic diagram illustrating the locking unit when the slide shaft 225 is moved to the direction shown by the arrow Y. FIG. 15C is a schematic diagram illustrating the locking unit when the slide shaft 225 is locked.

As illustrated in FIG. 14A, the frame 222 includes the groove portion 222*a* extending in an axial direction of the slide shaft 225, the lock rib 225*a* is inserted into the groove portion 222*a*, and the slide shaft 225 is supported by the frame 222 in a state of being movable to the axial direction of the slide shaft 225. The slide shaft 225 is supported by a support portion, not illustrated, provided to the frame 222 separately from the groove portion 222*a* so as not to fall down to the vertical direction. The frame 222 includes a holding portion 222*b* for holding an urging spring 236 (a first urging member) for urging the slide shaft 225.

As illustrated in FIG. 14B, the urging spring 236 includes a pressing portion 236*a* for pressing the pressed surface 225*c* of the slide shaft 225, and when the pressing portion 236*a* presses the pressed surface 225*c*, the slide shaft 225 is urged toward the rotation member unit 41. The pressing portion 236*a* presses the pressed surface 225*c* in a state in which the pressing portion 236*a* is disposed between the pressed surface 225*c* and the regulation portion 225*d*.

The frame 222 further includes a support portion 222*c* for turnably supporting the lock lever 27 as a locking member and a rotation regulation portion 222*d* for regulating rotation of the lock lever 27. The lock lever 27 includes a pressing surface 27*a* that a user can press, a rib regulation surface 27*b* for regulating a movement of the lock rib 225*a*, and a rib friction surface 27*c* with which the lock rib 225*a* frictions when the slide shaft 225 is moved. The lock lever 27 is urged by the lever spring 28 (a second urging member) provided to the frame 222 to rotate in a clockwise direction in FIG. 14A, however, the rotation in the clockwise direction is regulated by the rotation regulation portion 222*d*.

Next, the locking unit of the slide shaft 225 according to the present embodiment is described in detail with reference to FIGS. 15A to 15C.

In a state illustrated in FIG. 15A, the slide shaft 225 urges the rotation member unit 41 toward the coupling shaft 23 at the initial position (the first position), and the rotation member unit 41 is supported by the coupling shaft 23 and the slide shaft 225. Similar to the first embodiment, when the rotation member unit 41 is detached, a user first moves the rotation member unit 41 to the direction shown by the arrow Y and releases the support of the rotation member unit 41 by the coupling shaft 23. With the movement of the rotation member unit 41, the slide shaft 225 is moved to the direction shown by the arrow Y against an urging force of the urging spring 236, and thus, as illustrated in FIG. 15A, the lock rib 225*a* is also moved to the direction shown by the arrow Y.

At that time, the lock rib 225*a* is moved to the direction shown by the arrow Y while frictioning with the rib friction surface 27*c*, and as illustrated in FIG. 15B, the lock lever 27 turns to a direction (a counterclockwise direction) against an urging force of the lever spring 28. When the slide shaft 225 is further moved to the direction shown by the arrow Y against the urging force of the urging spring 236, the lock rib 225*a* reaches a position illustrated in FIG. 15C beyond the rib friction surface 27*c*. When the lock rib 225*a* reaches the position illustrated in FIG. 15C, the lock lever 27 turns in the clockwise direction in FIG. 15C by being urged by the lever spring 28 and then is regulated in rotation by the rotation regulation portion 222*d*.

At that time, the movement of the lock rib 225*a* is regulated in a state of abutting on the rib regulation surface 27*b* of the lock lever 27. The slide shaft 225 is urged by the urging force of the urging spring 236 to the direction shown by the arrow V, however, is regulated in movement at the position illustrated in FIG. 15C since the movement of the lock rib 225*a* is regulated by the lock lever 27. The position of the slide shaft 225 in FIG. 15C is regarded as the locking position (the second position). As described above, the slide shaft 225 is locked at the locking position by the locking unit including the groove portion 222*a*, the lock rib 225*a*, the lock lever 27, and the lever spring 28.

When the lock of the slide shaft 225 is released in the state illustrated in FIG. 15C, a user disposes the rotation member unit 41 on a position at which the rotation member unit 41 can be supported by the slide shaft 225 and the coupling shaft 23 and presses the pressing surface 27*a* of the lock lever 27. Accordingly, the lock lever 27 is rotated in the counterclockwise direction against the urging force of the lever spring 28, and engagement between the lock rib 225*a* and the rib regulation surface 27*b* is released. As a result, the lock rib 225*a* comes into a state in which the movement thereof is not regulated in the axial direction of the slide shaft 225, and the slide shaft 225 is urged toward the rotation member unit 41 by the urging force of the urging spring 236 and moved from the locking position to the initial position. Subsequently, the rotation member unit 41 is supported by the slide shaft 225 and the coupling shaft 23, and thus attachment of the rotation member unit 41 is completed.

As described above, in the configuration according to the present embodiment, the rotation member unit 41 is moved, and thus the slide shaft 225 can be moved from the initial position to the locking position against the urging force of the urging spring 236 and locked at the locking position. Therefore, according to the present embodiment, an effect similar to that according to the first embodiment can be obtained.

According to the first embodiment, the configuration is described in which the claw portion c1 as the engaging portion engages with the feeding roller arm 45, and thus the rotation member unit 41 is held by the feeding roller arm 45 in a state of not being supported by the coupling shaft 23 and the slide shaft 25. In contrast, according to a third embodiment, a configuration is described in which a rotation member unit 341 is not held by a feeding roller arm 345 in a state of not being supported by the coupling shaft 23 and the slide shaft 25 with reference to FIGS. 16A and 16B. The configuration according to the present embodiment is similar to that according to the first embodiment excepting configurations of the rotation member unit 341 and the feeding roller arm 345, so that the portions similar to those according to the first embodiment are denoted by the same reference numerals, and the descriptions thereof are omitted.

Figure 16A:
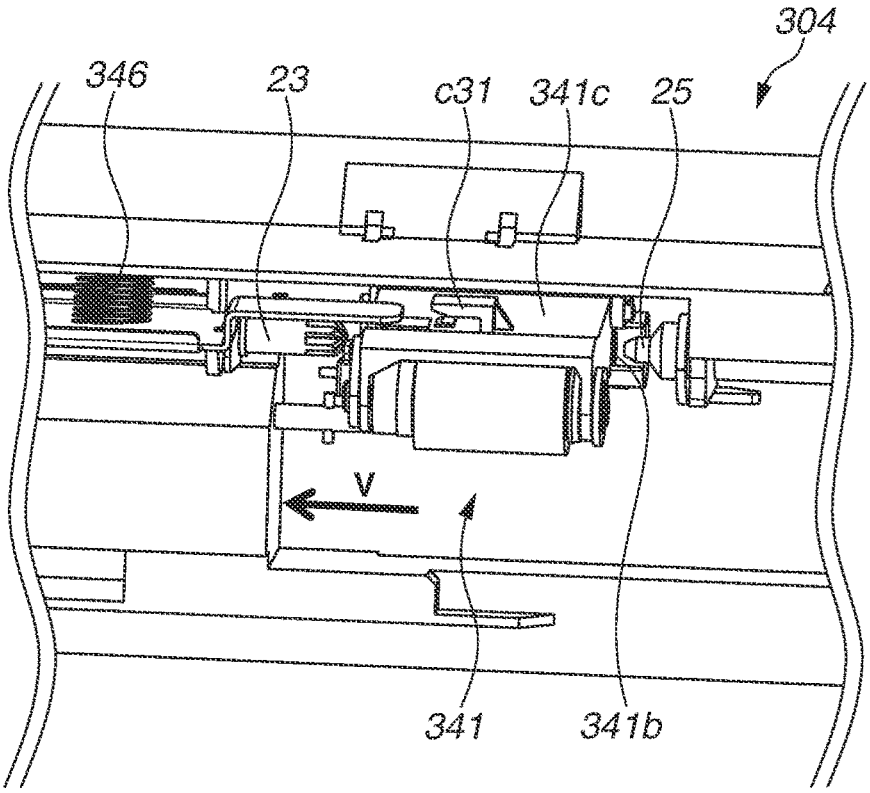
FIGS. 16A and 16B are schematic diagrams illustrating a configuration of a feeding unit according to a third embodiment.
Figure 16B:
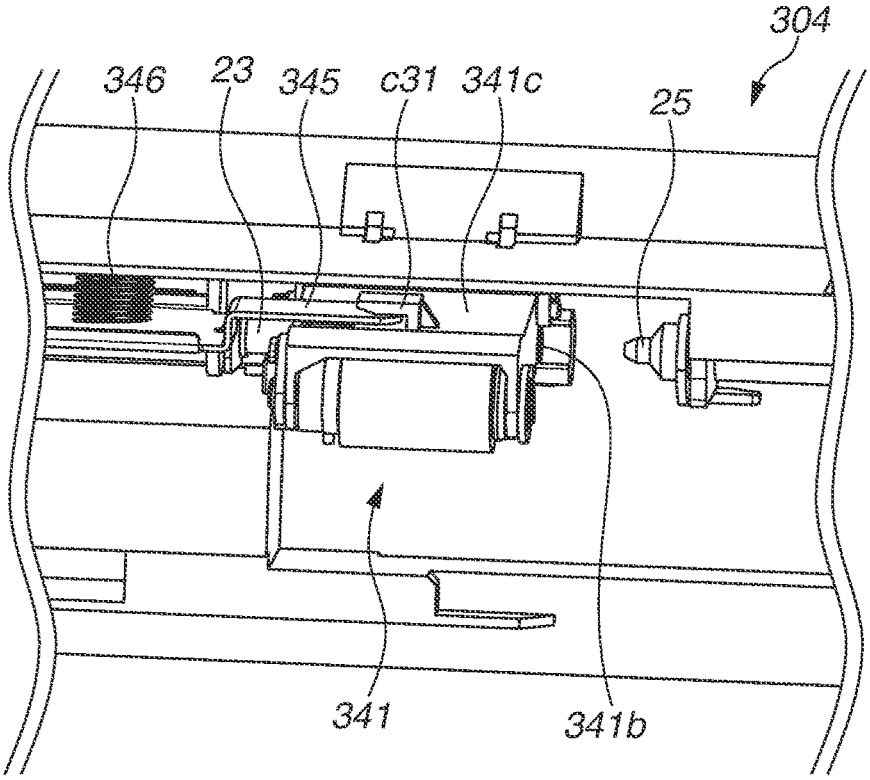

FIG. 16A is a schematic diagram illustrating the rotation member unit 341 in a state of not being supported by the coupling shaft 23 and the slide shaft 25 when the rotation member unit 341 is attached. FIG. 16B is a schematic diagram illustrating a state in which the rotation member unit 341 is moved to the axial direction of the coupling shaft 23 and supported by the coupling shaft 23 when the rotation member unit 341 is attached. According to the present embodiment, a detachment operation of the rotation member unit 341 and the locking unit of the slide shaft 25 are similar to those according to the first embodiment, and thus the descriptions thereof are omitted.

As illustrated in FIG. 16A, when the rotation member unit 341 according to the present embodiment is attached to a feeding unit 304, a user first inserts the rotation member unit 341 between the slide shaft 25 locked by the locking position and the coupling shaft 23. At that time, the rotation member unit 341 is in a state of not being supported by the coupling shaft 23 and the slide shaft 25, and a claw portion c31 as an engaging portion provided to a holder 341*c* of the rotation member unit 341 does not engage with the feeding roller arm 345.

From this state, the user slides the rotation member unit 341 to the direction shown by the arrow V, and as illustrated in FIG. 16B, the rotation member unit 341 is supported by the coupling shaft 23. At that time, the claw portion c31 engages with the feeding roller arm 345. The feeding roller arm 345 is urged by a spring 346 (a fourth urging member). The spring 346 urges the feeding roller arm 345, and thus the rotation member unit 341 can be urged toward the sheet S stacked on the stacking plate 30 of the sheet feeding cassette 3.

In the state illustrated in FIG. 16B, the coupling shaft 23, a conveyance roller 341*b*, and the slide shaft 25 are aligned on approximately the same axial line. In other words, the rotation member unit 341 is arranged on a position at which the rotation member unit 341 can be supported by the coupling shaft 23 and the slide shaft 25. Therefore, the lock of the slide shaft 25 is released in this state, the slide shaft 25 is moved from the locking position to the initial position, and accordingly the rotation member unit 341 is supported by the coupling shaft 23 and the slide shaft 25, and attachment of the rotation member unit 341 is completed.

According to the present embodiment, when the rotation member unit 341 is supported by the coupling shaft 23, the claw portion c31 engages with the feeding roller arm 345. Accordingly, there is no need to form the feeding roller arm 345 as an engaged portion in an entire area of a movement range of the rotation member unit 341 in the axial direction, and a length of the feeding roller arm 345 can be adjusted shorter. In addition, a length of the feeding roller arm 345 can be adjusted, and thus rigidity and arrangement accuracy of a tip end of the feeding roller arm 345 can be refined, and a degree of freedom for design can be refined.

According to the present embodiment, the lock of the slide shaft 25 is released after a user moves the rotation member unit 341 to a position at which the rotation member unit 341 is supported by the coupling shaft 23. However, without limited to the above-described configuration, the slide shaft 25 may be released from the lock in the state illustrated in FIG. 16A and urges the rotation member unit 341 toward the coupling shaft 23, and thus the rotation member unit 341 may be moved to the direction shown by the arrow V. In this case, the claw portion c31 engages with the feeding roller arm 345 almost at the same time as the rotation member unit 341 urged by the slide shaft 25 is supported by the coupling shaft 23 and the slide shaft 25, and the attachment of the rotation member unit 341 is completed.

According to the above-described embodiments, the examples are described as applied to an electrophotographic method type image forming apparatuses, however, the present example may be applied to an image forming apparatus other than the electrophotographic method type, for example, an ink-jet method image forming apparatus, without limited to the above-described examples.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-233353, filed Nov. 30, 2016, which is hereby incorporated by reference herein in its entirety.

What is claimed is:

1. A sheet conveying apparatus comprising:

a rotation member unit detachable from the sheet conveying apparatus, the rotation member unit including:

(i) a conveyance rotation member configured to convey a sheet, and (ii) a holding member including an engaging portion for engaging with an engaged portion provided to the sheet conveying apparatus and configured to hold the conveyance rotation member;

a supporting shaft configured to support one end side of the rotation member unit in an axial direction of the conveyance rotation member;

a moving shaft configured to support the other end side of the rotation member unit in the axial direction and be able to move to a first position for supporting the rotation member unit together with the supporting shaft and a second position further apart from the supporting shaft than the first position in the axial direction; and a locking unit configured to lock the moving shaft at the second position with respect to the sheet conveying apparatus, the moving shaft being locked at the second position by the locking unit after moving from the first position to the second position, wherein, in a state in which the moving shaft is locked at the second position by the locking unit and the rotation member unit is not supported by either one of the supporting shaft or the moving shaft, the rotation member unit is held by the engaged portion being engaged with the engaging portion and engagement between the engaging portion and the engaged portion is able to be released by moving the rotation member unit in a direction intersecting the axial direction.

2. The sheet conveying apparatus according to claim 1, wherein, to support the rotation member unit by the supporting shaft and the moving shaft, one end side of the conveyance rotation member is rotatably supported by the supporting shaft, and the other end side of the conveyance rotation member is rotatably supported by the moving shaft.

3. The sheet conveying apparatus according to claim 2, wherein the rotation member unit includes a conveyance gear provided with an engaging groove, and wherein, in a case where the engaging groove engages with the supporting shaft, the conveyance rotation member is rotatably supported by the supporting shaft.

4. The sheet conveying apparatus according to claim 2, wherein the conveyance rotation member includes an engaging hole, and wherein, in a case where the moving shaft engages with the engaging hole by the moving shaft being moved in a direction from the moving shaft toward the supporting shaft, the conveyance rotation member is rotatably supported by the moving shaft.

5. The sheet conveying apparatus according to claim 1, wherein, by the moving shaft being moved in a direction from the moving shaft toward the supporting shaft, the conveyance rotation member is urged toward the supporting shaft and then rotatably supported by the supporting shaft.

6. The sheet conveying apparatus according to claim 1, wherein, in a state in which the moving shaft is locked to the second position by the locking unit, the rotation member unit is able to be detached from the sheet conveying apparatus by the rotation member unit being moved to a position at which the rotation member unit is not supported by the moving shaft.

7. The sheet conveying apparatus according to claim 1, further comprising a first urging member configured to urge the moving shaft toward the rotation member unit in the axial direction, wherein, in a case where lock of the moving shaft by the locking unit is released, the moving shaft is moved from the second position to the first position by an urging force of the first urging member.

8. The sheet conveying apparatus according to claim 7, wherein the locking unit includes a protrusion portion provided to a frame of the sheet conveying apparatus and a groove portion which is provided to the moving shaft and on which a regulation surface abutting on the protrusion portion is formed, and wherein, in a case where the moving shaft moves from the first position to the second position while maintaining engagement between the protrusion portion and the groove portion, the regulation surface abuts on the protrusion portion at the second position and, accordingly, the moving shaft, in a state of being urged by the first urging member, is locked at the second position.

9. The sheet conveying apparatus according to claim 8, wherein the groove portion is formed to extend and twist in an axial direction of the moving shaft, and wherein the moving shaft is configured to move between the first position and the second position while rotating along a twist direction of the groove portion.

10. The sheet conveying apparatus according to claim 1, further comprising a first urging member configured to urge the moving shaft toward the rotation member unit in the axial direction, wherein the locking unit includes a groove portion which is provided to a frame of the sheet conveying apparatus and extends in an axial direction of the moving shaft, a protrusion portion which is provided to the moving shaft and inserted into the groove portion, a locking member configured to regulate a movement of the protrusion portion, and a second urging member configured to urge the locking member, and wherein the moving shaft is supported by the frame in a state of being movable to the axial direction, and a movement of the protrusion portion is regulated by the locking member urged by the second urging member, so that the moving shaft is locked at the second position moved from the first position.

11. The sheet conveying apparatus according to claim 10, wherein the locking member includes a friction surface which frictions against the protrusion portion and a regulation surface which abuts on the protrusion portion and is turnably supported by a support portion provided to the frame, wherein, in a case where the moving shaft is moved from the first position to the second position, the protrusion portion moves while frictioning against the friction surface and, accordingly, the locking member turns against an urging force of the second urging member, and wherein, in a case where the protrusion portion gets across the friction surface, and the moving shaft reaches the second position, the protrusion portion abuts on the regulation surface of the locking member urged by the second urging member, and a movement of the moving shaft urged by the first urging member is regulated, so that the moving shaft is locked at the second position.

12. The sheet conveying apparatus according to claim 1, wherein the engaging portion has a shape opened in the axial direction, and the rotation member unit is capable of moving to the axial direction while maintaining a state of engagement between the engaging portion and the engaged portion.

13. The sheet conveying apparatus according to claim 1, further comprising a storage unit configured to store a sheet, wherein the rotation member unit includes a feeding rotation member configured to feed the sheet stored in the storage unit to the conveyance rotation member, and the feeding rotation member, arranged on an upstream side from the conveyance rotation member in a sheet conveyance direction, is held by the holding member.

14. The sheet conveying apparatus according to claim 13, further comprising a third urging member configured to urge the engaged portion, wherein the third urging member urges the engaged portion toward the sheet stored in the storage unit and, accordingly, the rotation member unit is urged toward the sheet stored in the storage unit in a state in which the engaging portion engages with the engaged portion.

15. The sheet conveying apparatus according to claim 1, wherein the engaging portion includes a regulation surface for abutting on the engaged portion in a state in which the engaging portion engages with the engaged portion, and the rotation member unit is regulated in movement further toward the engaged portion than a position at which the regulation surface abuts on the engaged portion in a direction intersecting the axial direction by abutment of the regulation surface on the engaged portion.

16. The sheet conveying apparatus according to claim 15, wherein the regulation surface abuts on the engaged portion and, accordingly, the rotation member unit is arranged on a position at which the supporting shaft, the moving shaft, and the conveyance rotation member are aligned on approximately a same axial line and the rotation member unit is supported by the supporting shaft and the moving shaft.

17. The sheet conveying apparatus according to claim 1, further comprising a driving source configured to transmit a driving force to the supporting shaft, wherein the conveyance rotation member rotates by receiving the driving force from the driving source and conveys a sheet in a state in which the rotation member unit is supported by the supporting shaft.

18. An image forming apparatus comprising:

the sheet conveying apparatus according to claim 1; and an image forming unit configured to form an image on a sheet conveyed by the conveyance rotation member.

19. The sheet conveying apparatus according to claim 1, wherein, by the rotation member unit being moved in the axial direction from a position at which the rotation member unit is supported by the moving shaft and the supporting shaft to a position at which the rotation member unit is not supported by the supporting shaft, the moving shaft is locked at the second position by the locking unit after moving from the first position to the second position.

20. A sheet conveying apparatus comprising:

a storage unit configured to store a sheet;

a rotation member unit detachable from the sheet conveying apparatus, the rotation member unit including:

(i) a conveyance rotation member configured to convey a sheet, (ii) a feeding rotation member, arranged on an upstream side from the conveyance rotation member in a sheet conveyance direction, configured to feed the sheet stored in the storage unit to the conveyance rotation member, and (iii) a holding member including an engaging portion for engaging with an engaged portion provided to the sheet conveying apparatus and configured to hold the conveyance rotation member and the feeding rotation member;

a supporting shaft configured to support one end side of the rotation member unit in an axial direction of the conveyance rotation member;

a moving shaft configured to support the other end side of the rotation member unit in the axial direction and be able to move to a first position for supporting the rotation member unit together with the supporting shaft and a second position further apart from the supporting shaft than the first position in the axial direction;

a locking unit configured to lock the moving shaft at the second position with respect to the sheet conveying apparatus; and an urging member configured to urge the engaged portion to urge the rotation member unit toward the storage unit by the engaged portion being urged by the urging member toward the storage unit in a state in which the engaging portion engages with the engaged portion, wherein, by the rotation member unit being moved to a position at which the rotation member unit is not supported by the supporting shaft in the axial direction, the moving shaft is locked at the second position by the locking unit after moving from the first position to the second position, and the rotation member unit is held by the engaged portion in a state in which the engaging portion engages with the engaged portion.

* * * * *